US006296247B1

(12) United States Patent
Tamura et al.

(10) Patent No.: US 6,296,247 B1
(45) Date of Patent: Oct. 2, 2001

(54) SHEET STACKING APPARATUS WITH VERTICALLY MOVABLE TRAY

(75) Inventors: Masahiro Tamura, Yokohama; Kenji Yamada; Yukitaka Nakazato, both of Tokyo; Jun-ichi Iida, Yokohama; Akihito Andoh, Kawasaki; Yoshihiko Nakayama, Toyoake, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/201,661

(22) Filed: Dec. 1, 1998

(30) Foreign Application Priority Data

Dec. 1, 1997 (JP) ..... 9-330101
Feb. 24, 1998 (JP) ..... 10-042261

(51) Int. Cl.[7] ..... B65H 31/04
(52) U.S. Cl. ..... 271/214; 271/217; 270/58.13
(58) Field of Search ..... 271/214, 215, 271/217; 270/58.13, 58.12, 58.11

(56) References Cited

U.S. PATENT DOCUMENTS 4,189,133 * 2/1980 Arrasmith et al. ..... 270/61
4,455,115 * 6/1984 Alger et al. ..... 414/21
5,192,261 * 3/1993 Honjo et al. ..... 493/29
5,318,401 * 6/1994 Mandel ..... 414/792.7
5,480,130 * 1/1996 Suzuki et al. ..... 270/53
5,497,984 * 3/1996 Murakami et al. ..... 270/53
6,145,826 * 11/2000 Kawata ..... 270/58.28

FOREIGN PATENT DOCUMENTS 62-203159 12/1987 (JP) .
1-288566 11/1989 (JP) .
03-26658 2/1991 (JP) .
3-192065 8/1991 (JP) .
08-26569 1/1996 (JP) .
09-240901 9/1997 (JP) .

* cited by examiner

*Primary Examiner*—Donald P. Walsh
*Assistant Examiner*—David A. Jones
(74) *Attorney, Agent, or Firm*—Oblon, Spivak, McClelland, Maier & Neustadt, P.C.

(57) ABSTRACT

A sheet stacking apparatus includes a sheet discharge tray that holds a discharged sheet and that moves up and down, and a sheet discharge roller that is located above the sheet discharge tray and that discharges the discharged sheet to the sheet discharge tray. The sheet discharge tray receives the discharged sheet from the sheet discharge roller at a standard sheet receiving position which is located at a predetermined downward distance away from the sheet discharge roller. The sheet discharge tray moves down to a position which is lower than the standard sheet receiving position for a predetermined distance and receives at least a next sheet at the position, when a stacked amount of sheets on the sheet discharge tray reaches a predetermined stacking amount.

9 Claims, 20 Drawing Sheets

SHEET STACKING APPARATUS WITH VERTICALLY MOVABLE TRAY

BACKGROUND OF THE INVENTION

1. Field of the Invention

The present invention relates to a sheet stacking apparatus that is connected to a sheet discharge section of an image forming apparatus or the like.

2. Discussion of the Background

There is used a sheet stacking apparatus that includes a sheet discharge tray capable of raising and lowering in a vertical direction a stacking paper sheet (hereinafter referred to as a sheet) discharged from an image forming apparatus or the like and a sheet discharge roller, which is located at an upper part of the sheet discharge tray, for discharging the sheet to the sheet discharge tray. The sheet discharge tray of the sheet stacking apparatus receives the sheet from the sheet discharge roller at a standard sheet receiving position that is located at a predetermined downward distance away from the sheet discharge roller.

The aforementioned standard sheet receiving position is set in consideration of a normal sheet that is not stapled (hereinafter referred to as a non-stapled sheet) and is not curled, and even a stapled set of sheets having a mounded portion due to a thickness of staples is not apparently accounted for.

For example, as shown in FIG. 10, when a sheet discharge tray 12 stays at a standard sheet receiving position, the position of the sheet discharge tray 12 is at a predetermined distance L lower than a standard position relative to a sheet discharge roller 3, such as measured at a nip portion of the sheet discharge roller 3, for example. More particularly, the distance L is defined as a distance between the nip portion of the sheet discharge roller 3 and an upper surface of the sheet discharge tray 12 when the sheet discharge tray 12 is not loaded with the sheets, or between the nip portion of the sheet discharge roller 3 and an uppermost surface of the sheets on the sheet discharge tray 12 when the sheet discharge tray 12 is loaded with the sheets. Such a distance L is controlled to be constant by moving the sheet discharge tray 12 by a controller.

Actually, a height of the sheets stacked on the sheet discharge tray 12 is read by a sensor, and the distance L is controlled in accordance with the reading result by the sensor. The distance L accordingly may be within a certain range depending on an accuracy of the sensor.

When the sheet discharging tray 12 is not loaded with the sheets, the standard position for receiving the sheet is at the distance L beneath the nip portion of the sheet discharge roller 3. The sheet discharge tray 12 receives a first sheet discharged from the sheet discharge roller 3 at the standard sheet receiving position. The sheet discharge tray 12 has an open end side (downstream relative to the sheet after being discharged), which is positioned higher than a base end side (upstream relative to the sheet after being discharged) in a vertical direction. The sheet discharge roller 3 conveys and discharges the sheet toward the sheet discharging tray 12 with a certain degree of momentum.

After being discharged out of the sheet discharge roller 3 onto the sheet discharge tray 12, the sheet slides down along a slope of the sheet discharge tray 12 (to be more clear, the sheet slides down along the slope of the sheet stacked on the sheet discharge tray 12 in a switchback manner) by its own weight. The sheet is then stopped by a rear fence which is mounted on the base end side of the sheet discharge tray 12.

As the sheets are successively stacked on the sheet discharge tray 12, a height of a top surface of the sheets on the sheet discharge tray 12 increases. During this stacking operation, if the position of the sheet discharge tray 12 is not changed, a distance between the top surface of the stacked sheets and the sheet discharge roller 3 becomes smaller than the distance L which is made when the sheet discharge tray 12 is not loaded with the sheets. If such a distance becomes too small, the sheets discharged on the sheet discharge tray 12 can no longer be aligned properly. To avoid this problem, the sheet discharge tray 12 is controlled to lower each time when a sheet is stacked thereon so as to maintain the distance L within an appropriate range, and the sheets can be aligned.

Although an accurate and continuous control of the distance L is needed to be considered, the controller performs an intermittent control in which the sheet discharge tray 12 is lowered each time as part of the sheet stacking operation by an amount of distance so that the height of the top surface of the stacked sheets does not affect the alignment of the stacked sheets. The distance L is thus controlled to be constant within a predetermined allowance. The sheet discharge tray 12 repeats the above-described intermittent-lowering operation in accordance with a sheet stacking amount to receive the sheets. In such a case, the standard sheet receiving position is the top surface of the sheet discharge tray 12 (if the sheet discharge tray 12 is loaded with the sheets, the top surface of the sheets) which is positioned at the distance L, including the above-mentioned predetermined allowance, downward from the nip portion of the sheet discharge roller 3.

When the sheet stacking apparatus is combined with a staple device, the sheet discharge tray 12 may receive various differently-formed sheets from the sheet discharge roller 3. In some cases, the sheet discharge tray 12 may receive only non-stapled sheets or only a set of stapled sheets, or both non-stapled sheets and a set of the stapled sheets in a mixed fashion, depending upon the selected mode related to the sheets. In addition, such a sheet stacking status will be maintained until the sheets are removed from the sheet discharge tray 12.

The sheet stacked on the sheet discharge tray 12 generally has a curl like a convex or concave shape, regardless of being stapled or not and of an amount of the sheets. For example, when the non-stapled sheet having a convex-shaped curl is stacked one after another on the sheet discharge tray 12, the curls of the sheets are accumulated. This accumulation of curls causes the sheets to partly form a big mounded portion therein.

If such a situation arises, even though the height of the sheet discharge tray 12 is controlled around the standard sheet receiving position, the newly discharged sheet is caught at the aforementioned mounded portion of the previously stacked sheets on the sheet discharge tray 12, and the trailing edge of the sheet cannot slide down toward the rear fence. Hence, the sheets will be improperly aligned on the sheet discharge tray 12. Accordingly, the sheet that is caught on the mounded portion of the stacked sheets may be displaced at the leading edge side thereof toward the open end side of the sheet discharge tray 12.

When the sheet discharge tray 12 is loaded with the thus-displaced sheets, assuming that the next sheet is further discharged from the sheet discharge roller 3, the next sheet wraps over the aforementioned displaced sheets with the leading edge side thereof. Furthermore, the above-mentioned next sheet moves together with the displaced sheet by friction force. As a result, the misalignment of the stacked sheets occurs and, in an extreme case, the sheet may fall down from the sheet discharge tray 12.

Such a misalignment of the sheets caused by the curl also occurs in a case of the stapled sheets. For example, when the stapled sheets are discharged, since the stapled sheets are formed in a set and have a larger rigidity than the non-stapled sheet, the stapled sheets set is stopped by another set of stapled sheets that are stuck over the mounded portion due to the curl and improperly aligned. The stapled sheets set then pushes other sets of stapled sheets to fall down from the sheet discharging tray 12. In some cases, the leading edge of the next set of stapled sheets is stopped by the mounded portion of the stacked sets of the stapled sheets and convolve with the sheet discharge roller 3 nip or become misaligned.

The standard sheet receiving position of the sheet discharge tray 12 of the typical sheet stacking apparatus is determined in consideration of using ordinary sheets without curl or sheets which are stapled at a position which does not face the sheet discharge roller 3. Accordingly, a detecting position on the top surface of the stacked sheets for a sensor for setting and controlling the standard sheet receiving position of the sheet discharge tray 12 is deviated from the position that faces the sheet discharge roller 3.

This deviation of the detecting position may cause a problem of sheet stacking in some cases. That is, when a set of the sheets which is stapled at a rear end side thereof, or at a sheet discharge roller 3 side, is successively stacked, or when a sheet having a curl at the sheet discharge roller 3 side is successively stacked, the distance L may be maintained between the top surface of the stacked sheets and the sheet discharge roller 3 only at the beginning of a stacking operation of the sheets. Then, the stacked sheets may start to form a large mound with accumulated curls, in a convex direction as mentioned earlier, with increasing number of stacked sheets. In a case of the concave-shaped sheets, as also mentioned earlier, the curled portion thereof may largely be lifted up. Thereby, in an area that includes the top surface of the lifted-up portion of the stacked sheets and its vicinity, the distance between such an area and the sheet discharge roller 3 becomes smaller than the distance L.

In a case of a set of stapled sheets, since the thickness of the staples is accumulated in the number of a set of the stapled sheets, the sheets that are stuck by a set of stapled sheets are largely lifted up or mounded in a convex shape. Also, the distance between the top surface of such a displaced portion of the stacked sheets and the sheet discharge roller 3 becomes smaller than the distance L.

Thus, the distance between the top surface of the stacked sheets and the sheet discharge roller 3 becomes small at both cases of the curled sheet and a set of the stapled sheets. Then, the top surface of the curled sheet and the rear end portion of the vicinity of the top surface of the curled sheet or the staple portion of the stapled sheets eventually starts to rub with the sheet discharge roller 3. If such a rubbing occurs, stacking performance deteriorates due to convolvement of the sheets by the sheet discharge roller 3, or the load added to the sheet discharge roller 3 increases. In some cases, the sheet itself is damaged. In an excessive case, the sheet discharge roller 3 is scraped by the convolved sheets, or rotation of the sheet discharge roller 3 is stopped due to the excessive load caused by the convolved sheets. Furthermore, when a set of stapled sheets is discharged into the sheet discharge tray 12, the tip portion thereof hits and pushes the sheets already stacked at a portion mounded due to the staples, eventually pushing the sheets off of the sheet discharge tray 12 such that the sheets fall on the floor.

SUMMARY OF THE INVENTION

The present invention has been made in view of the above-discussed problems and an object of the invention is to address and resolve these and other problems.

Accordingly, to achieve the above-mentioned object, the present invention provides a novel sheet stacking apparatus, which includes a sheet discharge tray that holds a sheet that is discharged and that moves up and down, and a sheet discharge roller that is located above the sheet discharge tray and that discharges the sheet to the sheet discharge tray. The sheet discharge tray receives the sheet from the sheet discharge roller at a standard sheet receiving position located at a predetermined downward distance away from the sheet discharge roller. The sheet discharge tray moves down to a position that is lower than the standard sheet receiving position for a predetermined distance and receives at least a next sheet at the position, when a stacked amount of the sheets on the sheet discharge tray reaches a predetermined stacking amount of the sheets.

The present invention also provides another novel sheet stacking apparatus which includes a sheet discharge tray that holds a sheet which is discharged and that moves up and down, a sheet discharge roller that is located above the sheet discharge tray and that discharges the sheet to the sheet discharge tray, and a control device that controls the sheet discharge tray. The sheet discharge tray receives the sheet from the sheet discharge roller at a standard sheet receiving position located at a predetermined downward distance away from the sheet discharge roller. The control device controls the sheet discharge tray to move down from the standard sheet receiving position before the sheet discharge roller starts to rotate. The control device may selectively execute at least one of the first and second down modes.

Other objects, features and advantages of the present invention will become apparent from the following detailed description when read in conjunction with the accompanying drawings. Furthermore, while the drawings and descriptions illustrate specific structures, the present specification clearly explains the functions, concepts and attributes of the present invention in sufficient detail so as to make clear all equivalent structures and techniques for obtaining the desired result.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Hereinbelow, an embodiment of the present invention is described referring to the accompanied figures.

1. An Entire Construction of a Sheet Post Processing Apparatus

Figure 1:
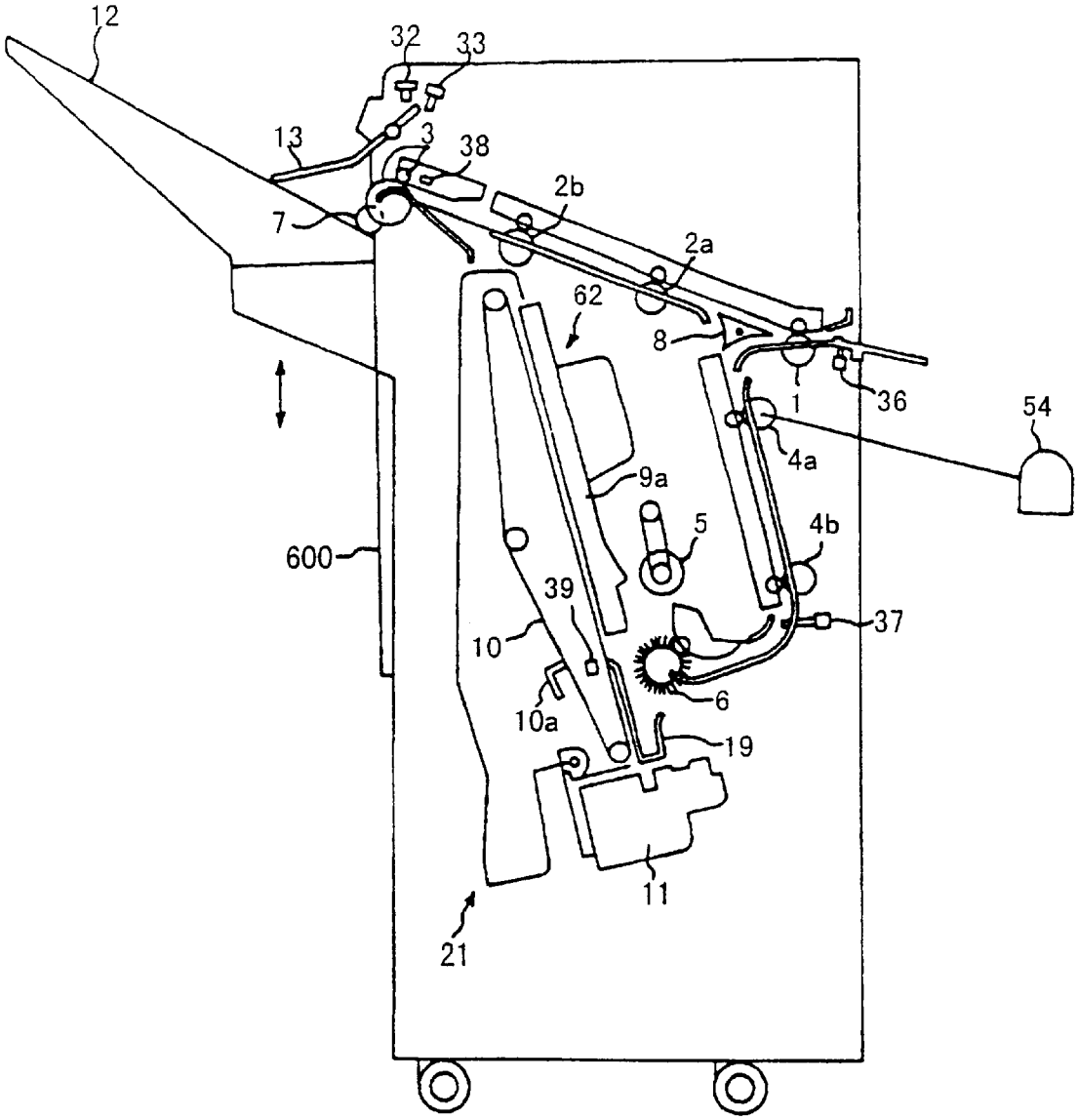
FIG. 1 is a side view of an entire construction of a sheet stacking apparatus according to the present invention.

A preferred construction and schematic operation of a sheet stacking apparatus of the present invention is explained referring to FIGS. 1 to 9. In FIG. 1, a finisher 600 is an embodiment of a sheet post processing apparatus that processes a recorded sheet for sorting, stacking, and stapling, which is discharged from a copying machine or the like (not shown). With respect to the finisher 600, an entrance sensor 36, an entrance roller 1 and a selection pick 8 are mounted therein at an entrance of a sheet conveying path from the copying machine or the like, in the order of a proceeding direction of the sheet.

The sheet to be conveyed toward a sheet discharge tray 12 or that to be conveyed toward a staple device 11 is separated by a rotating motion of the selection pick 8. At a conveying path toward the sheet discharge tray 12, there are disposed a pair of upper conveying rollers 2*a* and 2*b*, a sheet discharge sensor 38 that detects a leading edge and a trailing edge of the sheet, a pair of sheet discharge rollers 3 (hereinafter referred to as a sheet discharge roller 3), positioning roller 7, sheet surface lever 13, sheet surface sensors 32 and 33 (See FIGS. 7A and 7B) and the like.

A lower pair of conveying rollers 4*a* and 4*b*, a sheet discharge sensor 37, a sheet conveyance roller (brush roller) 6 are disposed at a conveying path in a direction toward the staple device 11. A lower conveying roller 4*a* and a lower conveying roller 4*b* that are connected by a belt are driven by a conveyance motor 54 described later. The sheet discharge tray 12 is moved by an up-and-down motor 23 and a shift motor 52 (FIG. 6) in an upward and a downward directions (in FIG. 1), or rightward and leftward directions (penetrating direction to the sheet surface in FIG. 1) as needed.

Figure 2:
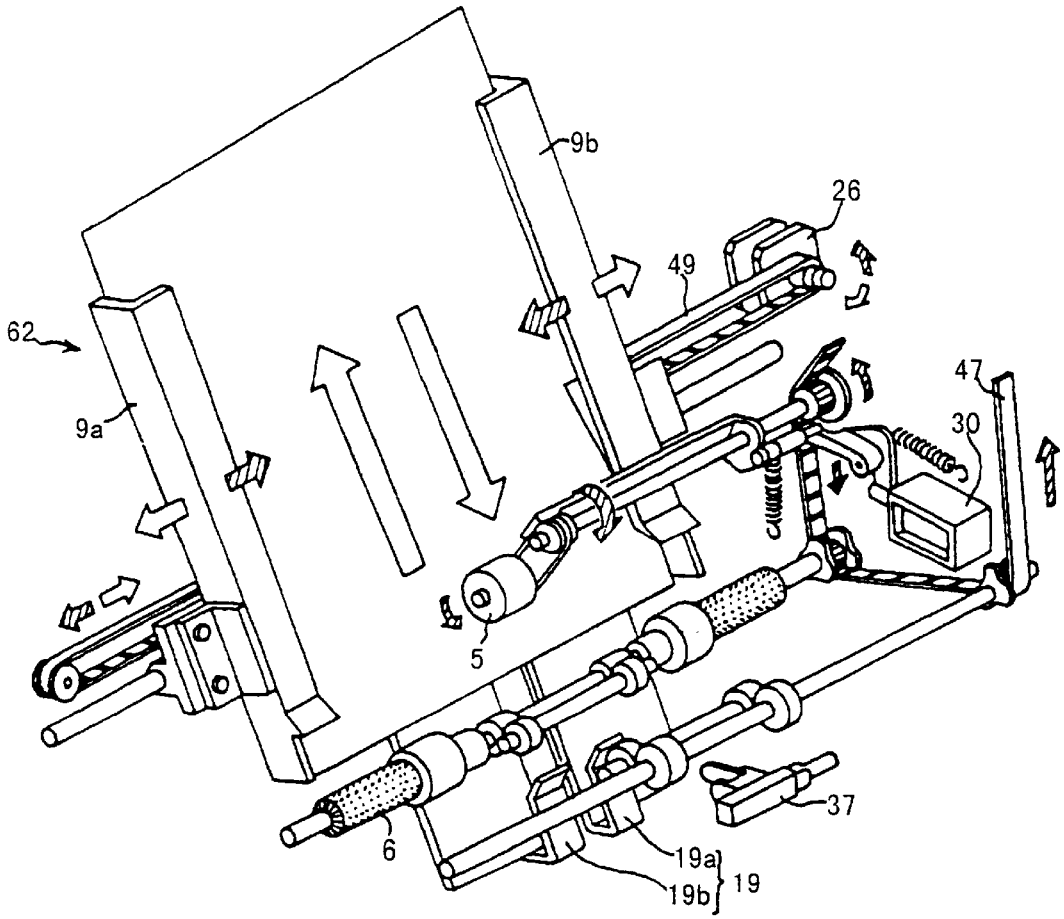
FIG. 2 is a perspective view explaining a main part of the sheet stacking apparatus.
Figure 4:
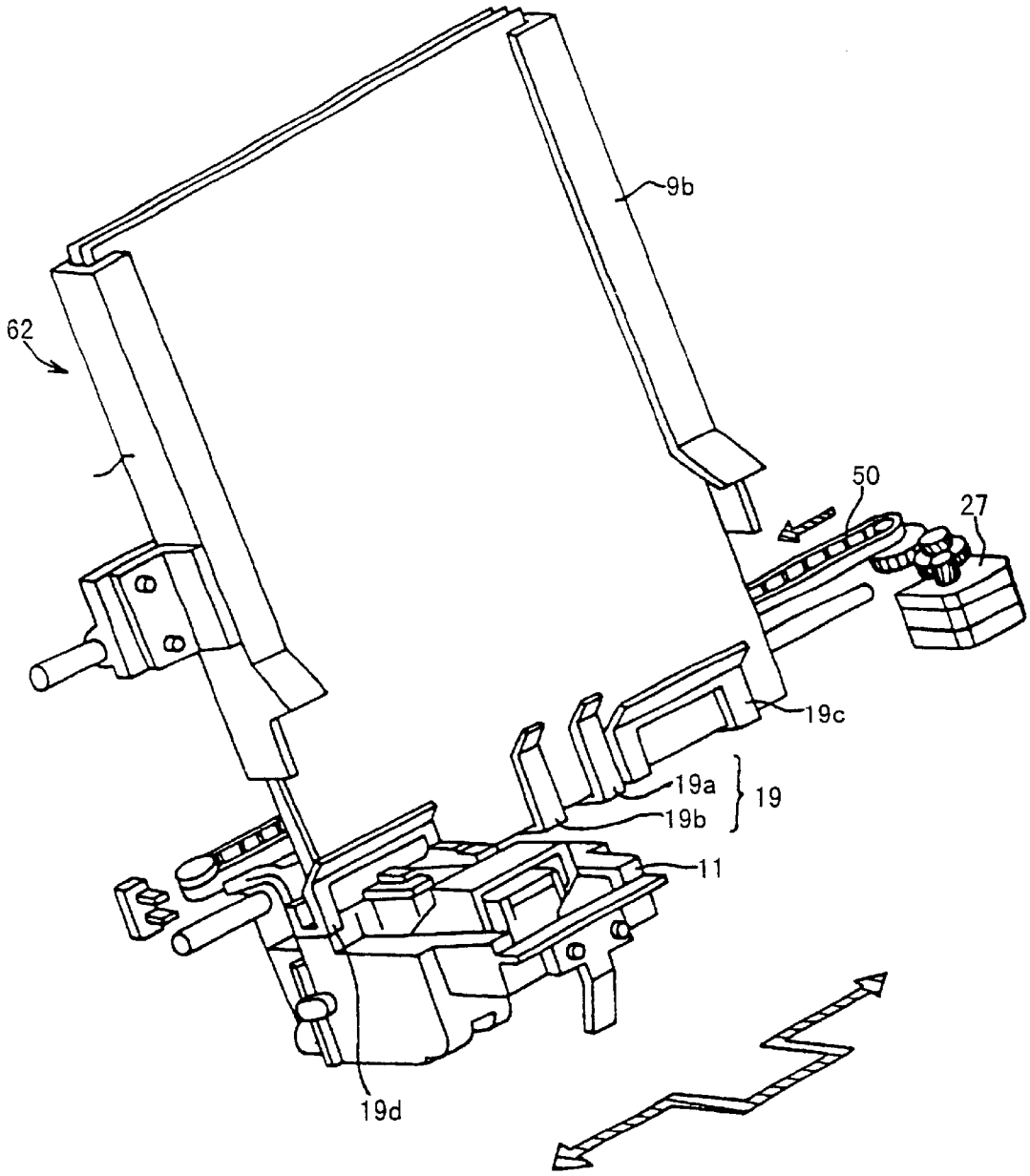
FIG. 4 is a perspective view of a staple section of a sheet post processing apparatus.

As shown in FIG. 4, the staple device 11 is mounted beneath a staple tray 62. A pair of jogger fences 9*a* and 9*b* for aligning the sheets, a returning roller 5, a discharge belt 10 at a position located behind a pair of the jogger fences 9*a* and 9*b* for discharging a bundle of stapled sheets, are disposed at the staple tray 62, as shown in FIGS. 1 and 2. A pair of the jogger fences 9*a* and 9*b* are driven by a jogger motor 26 through a jogger belt 49, as shown in FIG. 2. The returning roller 5 is provided for swinging motion by a positioning solenoid.

Figure 3:
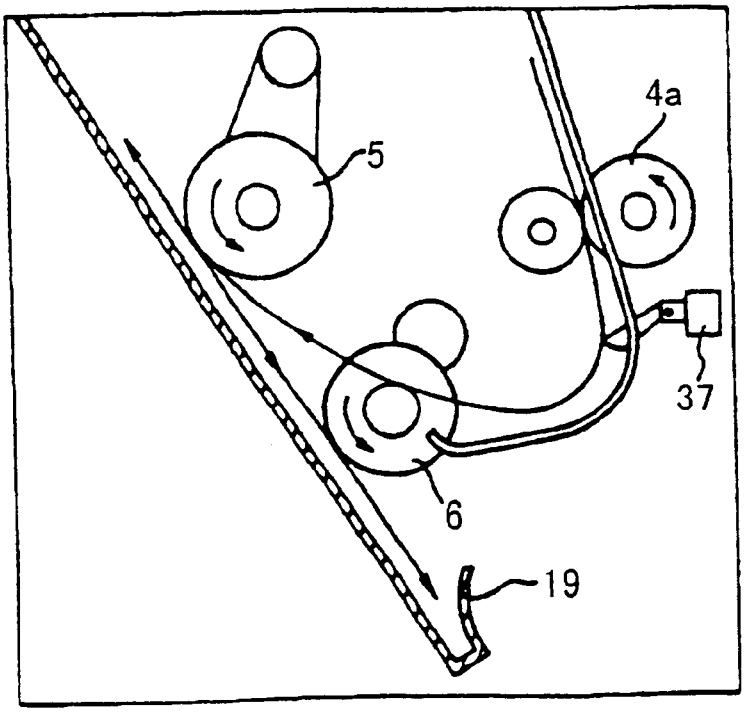
FIG. 3 is an explanatory side view of a vicinity of a jogger fence of a staple tray.

A rear end fence 19 for receiving and stopping a lower side (trailing edge) of the sheet is mounted beneath a pair of the jogger fences 9*a* and 9*b*, as shown in FIGS. 3 and 4, though omitted in FIG. 2.

The staple device 11 is mounted on a staple belt 50, as shown in FIG. 4, and moves in a lateral direction (penetrating direction in FIG. 1) in response to a movement of the staple belt 50 caused by a stapler moving motor 27. A sheet discharge sensor 37 detects the trailing edge of the sheet, as shown in FIGS. 1 and 2. The positioning solenoid 30 causes to move the returning roller 5 by a turning on command based on a trailing edge detection signal of the sheet discharge sensor 37. The returning roller 5 is disposed at a position capable of knocking the trailing edge of the sheet and aligns the sheets.

Figure 6:
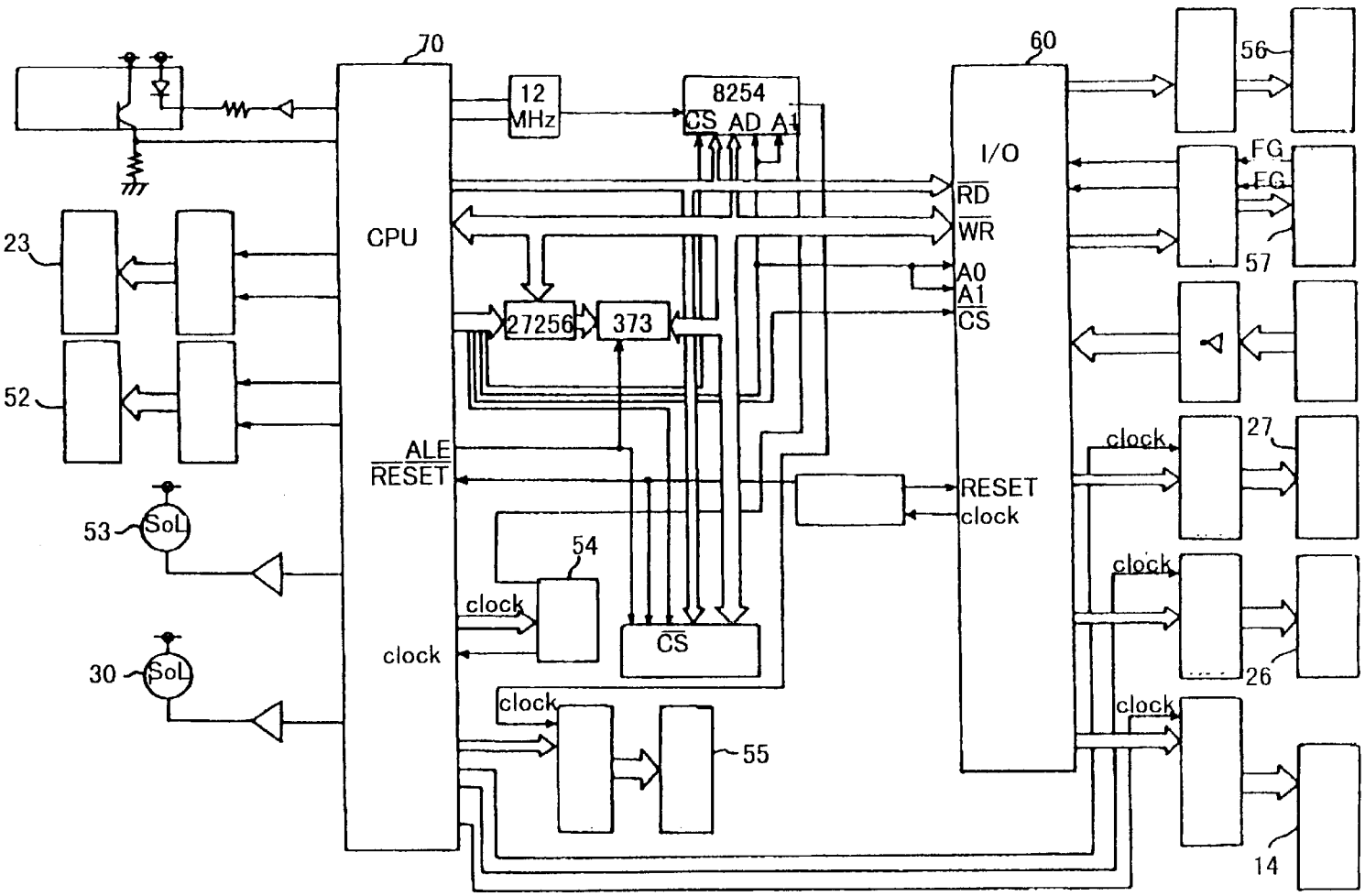
FIG. 6 is a block diagram of a control device for the sheet post processing apparatus.

A circuit construction using a micro computer as a built-in control device in the sheet post processing apparatus is explained referring to FIG. 6.

Each of the signals from each switch and each sensor or the like is inputted to a CPU 70 through I/O interface 60. The CPU drives the up-and-down motor 23, the shift motor 52, a selection solenoid 53, the positioning solenoid 30, the conveyance motor 54, a sheet discharge motor 55, a staple motor 56, a discharge motor 57, the stapler moving motor 27, and the jogger motor 26 corresponding to each of the signals inputted thereto.

A pulse signal of the conveyance motor 54 is counted when inputted to the CPU, and the positioning solenoid 30 is controlled in accordance with a count data. An alignment control device for aligning the sheets is composed of the CPU and various operation programs that drive the CPU.

2. An Operation of the Sheet Post Processing Apparatus

An operation of the aforementioned construction in a case of selecting a usual mode that does not operate a staple process is explained. In FIG. 1, a copied sheet is received by an entrance roller 1, proceeds along a path directed to the sheet discharge tray 12 by a course control of the selection pick 8, conveyed by a pair of the upper conveying rollers 2*a* and 2*b*, and discharged by a pair of the sheet discharge rollers 3.

As shown in FIGS. 1, 7A, 8 and 9, on a stacking surface of the sheet discharging tray 12, the positioning roller 7 made of a sponge like material swingably contacts by its own weight. The sheet discharged to the sheet discharge tray 12 slides down along the inclined surface thereof in a switchback manner. When the sheet is sandwiched by the positioning roller 7 at a lower side (trailing edge) thereof, the sheet is driven by the positioning roller 7 to be conveyed downward and rammed against a rear end fence 29 (See FIG. 7A) as a sheet receiving device. Thus, an alignment of a longitudinal direction of the sheet (sheet conveying direction) is performed. The positioning roller 7 rotates for driving the sheet to be conveyed downward and in addition, a rotation speed of the positioning roller 7 is decreased when the sheet discharge sensor 38 detects the trailing edge of the sheet to improve a stacking performance.

Figure 7A:
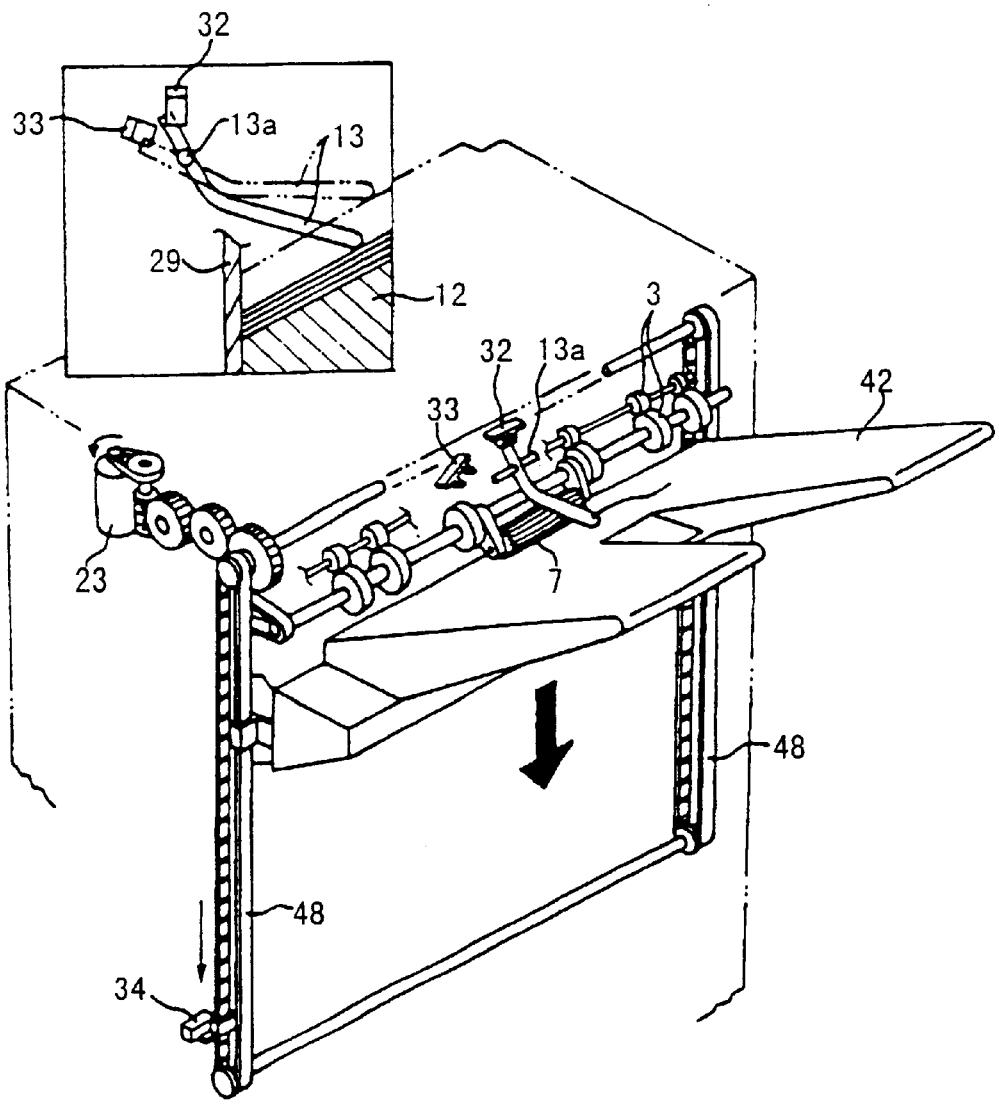
FIG. 7A is a perspective view explaining a main part of the sheet stacking apparatus.

Thus, the copied sheets are discharged onto the sheet discharge tray 12 one after another in order. Thereby, a top surface of the sheets stacked on the sheet discharge tray 12 is raising up. An end side of the sheet surface lever 13, which is swingably supported on a shaft 13*a,* is mounted to contact the top surface of the sheets stacked on the sheet discharge tray 12 with its own weight, as shown in FIG. 7A. Another end side of the sheet surface lever 13 is constructed to be detected by the sheet surface sensor 33 composed of a photo interrupter.

The sheet surface sensor 33 is prepared for controlling a raising-and-lowering position of the sheet discharge tray 12 in the usual mode in which the staple process is not performed, and further, the sheet surface sensor 32 is prepared for controlling the raising-and-lowering position in a staple mode. The sheet surface lever 13 is rotatable with a moment by its own weight about a fulcrum, and is constructed with a stopping member for stopping a rotation of the free end portion of the sheet surface lever 13 at a position where the sheet surface lever 13 turns on the sheet surface sensor 32 or 33.

The stopping member hooks and stops at the position of sheet surface sensor 33 and turns on the sheet surface sensor 33 when in the usual mode. And when in the staple mode, the stopping member hooks and stops at the position of the sheet surface sensor 32 and turns on the sheet surface sensor 32. When the sheets are stacked on the sheet discharge tray 12 one after another, the free end portion of the sheet surface lever 13 is pushed up by the stacked sheets. When the sheet surface lever 13 moves out from the sheet surface sensor 32 or 33, the sheet surface sensor 32 or 33 is turned off.

At this moment, since the usual mode is selected, the top surface of the stacked sheets on the sheet discharge tray 12 raises every time when the sheet is discharged one after another from the sheet discharge roller 3. Accordingly, a control is performed so that the sheet discharge tray 12 is lowered by driving the up-and-down motor 23 until the sheet surface sensor 33 turns on every time when the free end portion of the sheet surface sensor 13 leaves from the sheet sensor 33.

Figure 10:
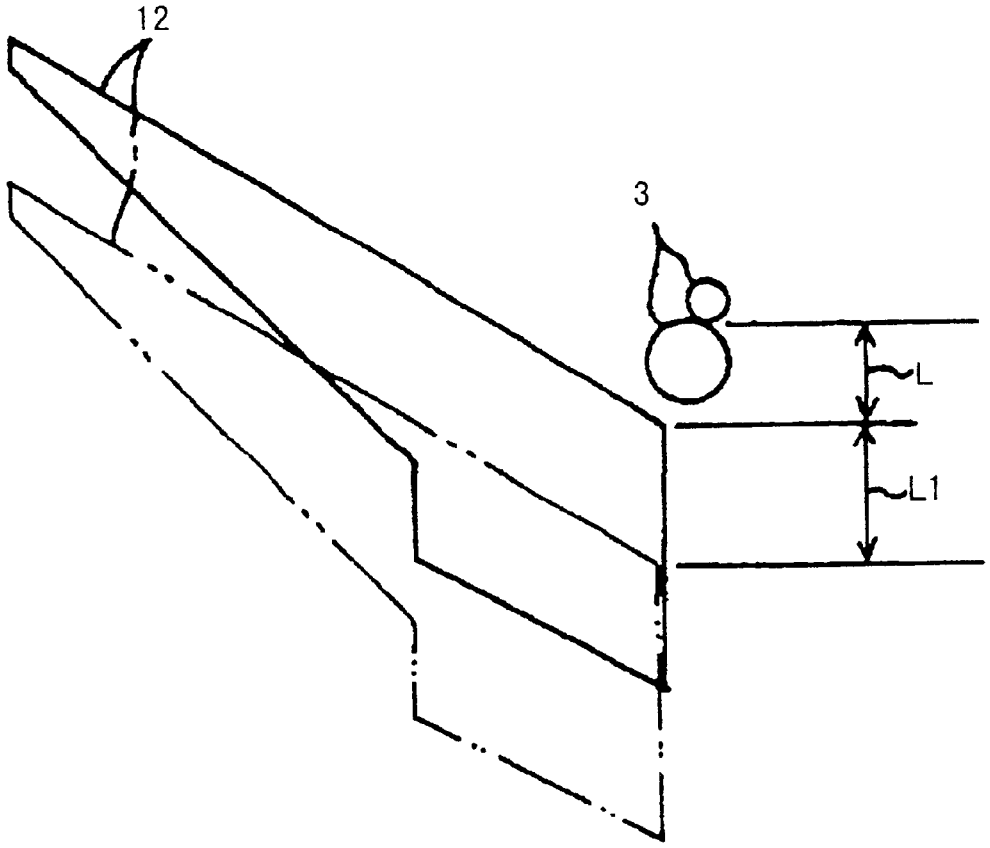
FIG. 10 is a side view illustration explaining a position of a sheet discharge tray.

Thereby, a condition of touchdown position of the sheet on the sheet discharge tray 12 is controlled on the basis of a constant value. In other words, the distance between the sheet discharge roller 3 and the sheet discharge tray 12 (the top surface of the sheets) is controlled to the distance L, as shown in FIG. 10. FIG. 10 shows the embodiment in which the sheet discharge tray 12 is not loaded with sheets. However, even in case of the sheet discharge tray 12 loaded with sheets, the separating distance between the top surface of the stacked sheets and the sheet discharge roller 3 is controlled on the basis of the distance L. Thus, the position of the sheet discharge tray 12 having a predetermined distance from the sheet discharge roller 3 is called "a standard sheet receiving position", and is an appropriate position that is set for receiving a normal sheet, which is not a special sheet having the curl or the like.

The standard sheet receiving position in a case of discharging the sheet one after another in the usual mode and that in a case of discharging the sheets which are stapled in the staple mode is naturally different from each other. This is clear because the positions of the sheet surface sensor 32 and 33 are set different from each other.

Further, in the sort/stack mode, the sheet discharge tray 12 is shifted in a predetermined amount in a lateral direction by use of the shift motor 52 according to a sorting signal generated from a control panel in the main body of the copying machine. The sorting operation is performed until the job ends by differing the stacking position. Furthermore, the sheet discharge tray 12 is lowered about 30 mm for preparing the sheets to be removed when the job ends.

Next, an operation of performing a staple process in the staple mode is explained hereinbelow. When the staple mode is selected, a pair of the jogger fences 9*a* and 9*b* move from a home position and wait at a position which is apart from side lines of the sheets, about 7 mm at one side as shown in FIG. 2. In FIG. 1, when the sheet is driven by the conveyance motor 54, the sheet is conveyed by lower conveying rollers 4*a* and 4*b*. When the sheet passes through the sheet discharge sensor 37, a pair of the jogger fences 9*a* and 9*b* jogs the sheet 5 mm inward from the waiting position (a movement indicated by striped arrows in FIG. 2).

Further, at a time point when the sheet passed through the sheet discharge sensor 37, the sheet discharge sensor 37 detects a pass of the trailing edge of the sheet, and inputs the signal to the CPU 70. The CPU counts an oscillating pulse from the conveying motor 54, from the time point when the signal is received and turns on the positioning solenoid 30 after a predetermined number of pulses has oscillated.

The returning roller 5 swings up and down by turning on and off of the positioning solenoid 30. The returning roller 5 knocks the sheet and returns the sheet downward at a time when the positioning solenoid is turned on. The returning roller 5 aligns the sheets by ramming the same against the rear end fence 19. At this moment, at every time when the sheet passes through the entrance sensor 36 (or the sheet discharge sensor 37), the signal generated by the entrance sensor 36 (or sheet discharge sensor 37) is inputted to CPU 70, and the number of the sheets received by the staple tray is counted.

After a predetermined time has passed from the time when the positioning solenoid 30 is turned off, a pair of the jogger fences 9*a* and 9*b* move inward by 2 mm by the jogger motor 26 and temporarily stop, and the lateral alignment is finished. Thereafter, a pair of the jogger fences 9*a* and 9*b* returns 7 mm and wait for the next coming sheet. This procedure is repeated until the end of the last sheet. At the last sheet, the jogging operation for 7 mm is again performed and the pair of the jogger fences 9*a* and 9*b* fix the both side ends of the bundle of the sheets for preparing the staple operation.

Thereafter, the staple device 11 operates after a predetermined time has passed, and the staple process is performed. At this moment, if a staple operation for a plurality of staple positions is indicated, the stapler moving motor 27 is driven to move the staple device 11 to an appropriate position along the trailing edge of the sheets after a first staple process is finished and then a second staple process is performed.

Figure 5:
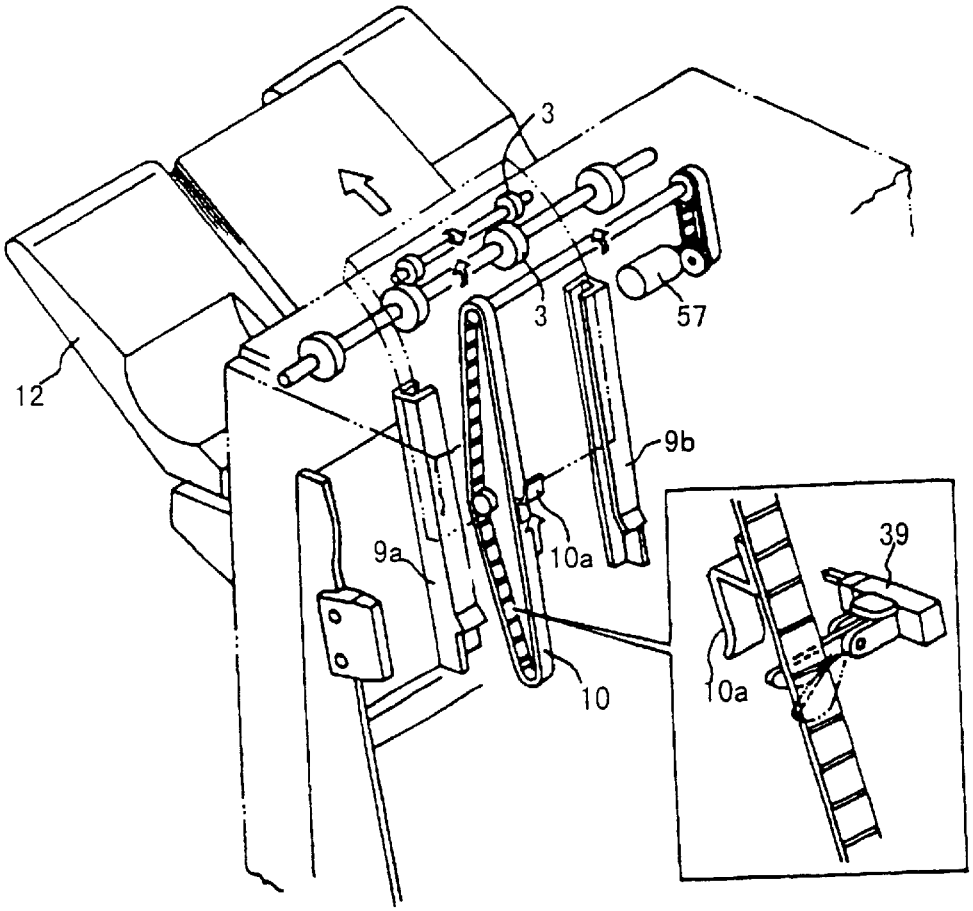
FIG. 5 is an explanatory perspective view of a sheet conveyance system for conveying the sheet after a staple process is completed.

When the staple process is finished, the discharge belt 10 is driven by driving the discharge motor 57, as shown in FIG. 5. At this moment, sheet discharge motor 55 is also driven to start rotation for receiving the bundle of the sheets lifted by the discharge belt 10. The pair of the jogger fences 9*a* and 9*b* are controlled for performing the changing the operation for each of the sizes and the number of the stapled sheets, respectively. For example, when the number of the stapled sheets is less than the set number of the sheets or the size of the sheets is smaller than the size which was previously set, the bundle of sheets is hooked and conveyed by a discharge pawl 10*a* at a trailing edge thereof being sandwiched and supported by a pair of the jogger fences 9*a* and 9*b*. Further, the sheets are released from cramping by the pair of the jogger fences 9*a* and 9*b* by retreating the jogger fences 9*a* and 9*b* for 2 mm after the predetermined pulse is counted by a discharge belt home sensor 39. The predetermined number of the pulse is set between a time when the discharge pawl 10*a* rams against a rear end of the bundle of the sheets and the time when the discharge pawl 10*a* passes away from a tip end portion of the pair of the jogger fences 9*a* and 9*b*.

When the number of stapled sheets is larger than that which is previously set, or the size of the stapled sheets is larger than the set size, the sheets are discharged previously retreating the pair of jogger fences 9*a* and 9*b* for 2 mm. In any case, when the bundle of sheets passes by the pair of jogger fences, the pair of jogger fences 9*a* and 9*b* further move for 5 mm to return the waiting position and prepare for next sheet coming out of the sheet discharge roller 3. Furthermore, the cramping force can be adjusted by setting the distance of the pair of the jogger fences 9*a* and 9*b* from the sheet. The sequential operation is repeated until the last job is finished.

Figure 7B:
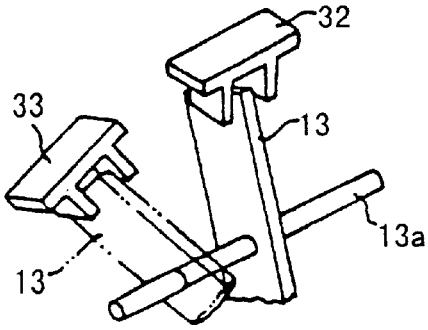
FIG. 7B is a perspective view of a sheet surface sensor.

The sheet discharge tray 12 is hung on up-and-down lift belts 48, as shown in FIG. 7A. The up-and-down lift belts 48 are driven by the up-and-down motor 23 through gears and timing belts, and is raised and lowered by a forward rotation or reverse rotation of the up-and-down motor 23. FIG. 7B illustrates the sheet receiving position of the sheet discharge tray 12 based on a home position. The sheet receiving position is set by detecting the sheet receiving position with the sheet surface lever 13 which is rotatably supported in an up-and-down direction and the sheet surface sensor 32 and 33 (sheet surface sensor 33 is for the usual mode, and sheet surface sensor 32 is for the staple mode).

In any mode, the sheet from the sheet discharge roller 3 is discharged onto the sheet discharge tray 12 at the standard sheet receiving position in each of the modes. The sheet discharge tray 12 is lowered each time a sheet is stacked, and finally, the lowermost limit position is detected by a lowermost limit sensor 34. Further, when the sheet discharge tray 12 is raised, and if the sheet discharge tray 12 reaches the predetermined uppermost limit position, the positioning roller 7 also is pushed up by the upper surface of the sheet discharge tray 12, as shown in FIG. 9.

The positioning roller 7 is swingable about a fulcrum shaft 7*a* as a rotation center, and when the sheet discharge tray 12 reaches the predetermined uppermost limit position, an end portion of a swingable lever presses the uppermost limit switch 31 of the sheet discharge tray 12 to turn on.

Figure 8:
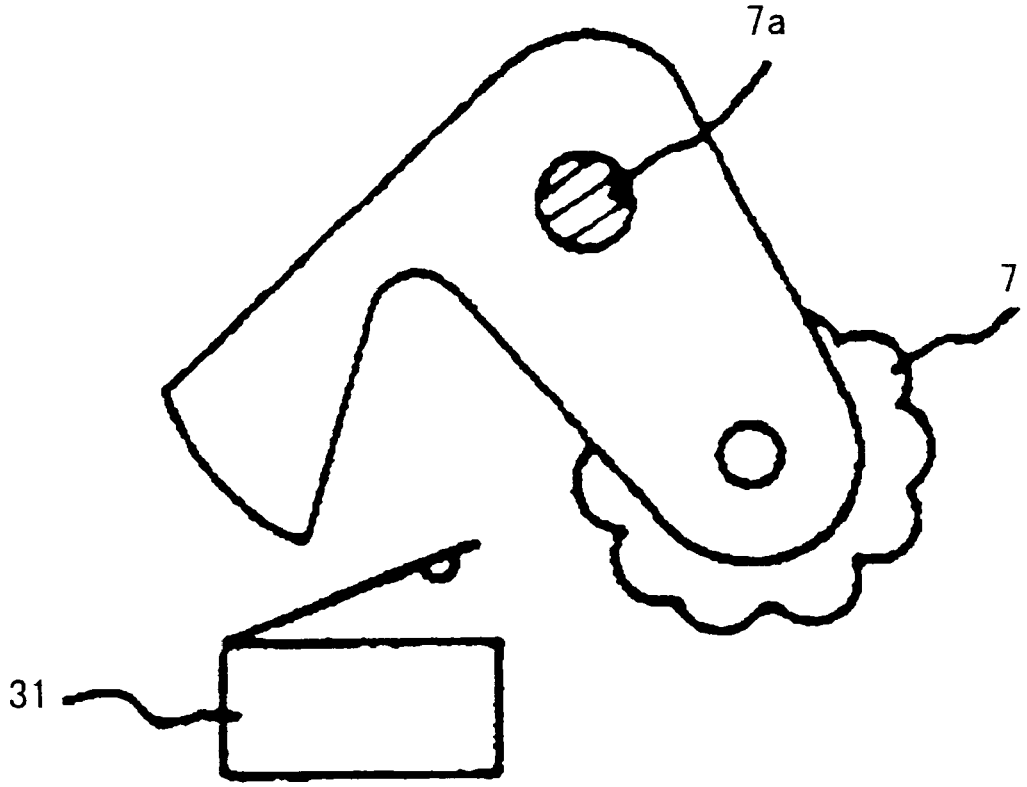
FIG. 8 is a side view illustration explaining an action status of a positioning roller.
Figure 9:
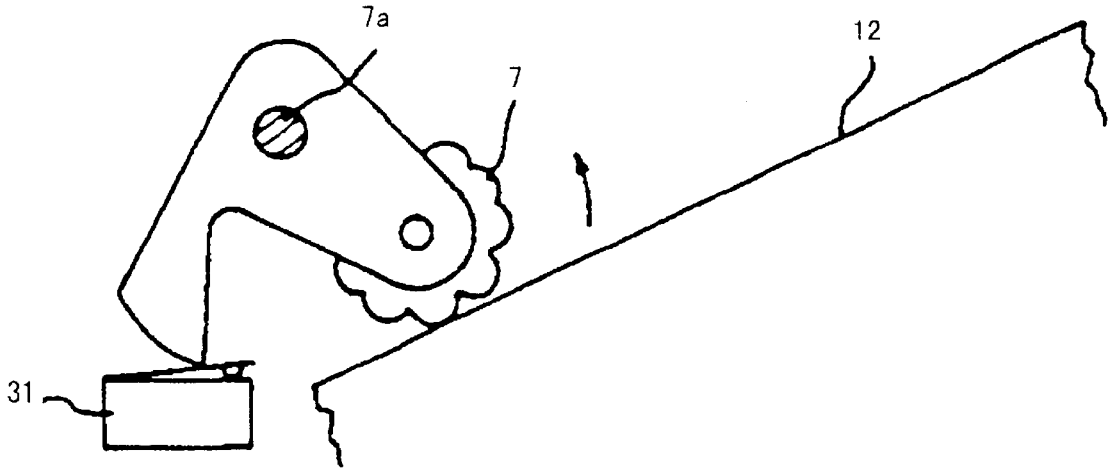
FIG. 9 is a side view illustration explaining another action status of the positioning roller.

FIG. 8 illustrates a condition where the uppermost limit switch 31 is turned off, and FIG. 9 illustrates a condition where the uppermost limit switch 31 is turned on. When the uppermost limit switch 31 is brought to an off state, as shown in FIG. 9, the drive power of the up-and-down motor 23 is brought to a stop, and the parts located upward the sheet discharge tray 12 is prevented from being damage due to overrun of the sheet discharge tray 12.

The rear fence 19 shown in FIG. 4 is composed of four parts. Both of fences 19*a* and 9*b* are fixed type and are fixed on the staple tray 62. Both of fences 19*c* and 19*d* are movable type and are mounted on the staple device 11 so as to move together with the staple device 11.

The operation of the sheet post processing apparatus is described above. As described above, since there occurs a problem caused by a condition where the sheets stacked on the sheet discharge tray 12 touch the sheet discharge roller 3, or the condition where the sheets already stacked on the sheet discharge tray 12, although in an untidy fashion, and a next sheet from the sheet discharge roller 3 interfere each other, the sheet post processing apparatus is constructed such that when a certain stacking state before occurrence of the problem is detected, the controller lowers the sheet discharge tray 12 to a position where such a problem does not occur. In other words, the present invention takes preventative measures to minimize the possibility of having discharged sheets collide with one another in a deconstructive manner. Namely, the sheet discharge tray 12 is lowered from the standard sheet receiving position, and receives the next sheet at a position where the sheet discharge tray 12 is on its way of being lowering, just stopped lowering, or on a raising process after lowering process is finished. Any one of such positions is no need to say that the above-mentioned problem does not occur. As a control device for operating such a control, the construction shown in FIG. 6 is adopted.

In the below described embodiment, the sheet stacking apparatus is composed of the sheet discharge tray 12, sheet discharge roller 3, the sheet discharge sensor 38 mounted just before the sheet discharge roller 3, a device which can recognize any change for the sheet to proceed to the sheet discharge tray 12 capable of discharging, which is mounted at upstream of the sheet discharge sensor 38 (corresponds to the discharge belt home sensor 37 or the entrance sensor 36), a drive system such as motors for driving these elements, and a finisher 600 containing the control device with the CPU 70 as a main component that controls the above-mentioned elements shown in FIG. 6.

The sheet stacking apparatus provided with such a construction can be used connecting to an apparatus that stacks the sheets, such as, a facsimile machine, a copying machine, and the like in a wide range that discharges the sheets.

In this embodiment, the next coming sheet is received by the sheet discharge tray 12 that stays at a position which is lower than the nip portion of the sheet discharge roller 3 in distances "L+L1" when a stacked amount of the sheets on the sheet discharge tray 12 reaches a predetermined stacking amount of the sheets, as shown in FIG. 10. At this moment, the predetermined stacking amount implies a stacking amount that can arbitrarily be determined within the stacking amount before the trailing edge of the sheet touches the sheet discharge roller 3 or the misalignment of the sheets occurs by being affected by a curl or a thickness of the staples of the stacked sheets.

When the sheets reach such a stacking amount, the sheet discharge tray 12 is lowered from the standard sheet receiving position in the distance L1. The distance L1 corresponds to the predetermined stacking amount on the sheet discharge tray 12 relative to the standard sheet receiving position. A position of the sheet discharge tray 12 after being lowered by the predetermined distance L1 is indicated by a two-dots-and-a-dash line in FIG. 10.

A substantial value of the predetermined distance L1 is individually set according to the curl of the sheets stacked on the sheet discharge tray 12, or the thickness of the staples. A basis for setting the predetermined distance L1 is determined in consideration of a state that the trailing edge of the sheet already stacked can be separate from the sheet discharge roller 3, even though the trailing edge of the sheet tends to touch the sheet discharge roller 3 due to a curl propensity of the curl of the sheet or the thickness of the staples of the stacked sheets. In other words, the basis for setting the predetermined distance L1 is determined in consideration of a state that the sheet discharged from the sheet discharge roller 3 can sufficiently pass over the mound of the sheets that is already stacked, and that this discharge operation does not cause any trouble for an appropriate alignment of the stacked sheets. Further, since the timing for the sheet discharge tray 12 to receive the next coming sheet can be considered that the sheet discharge tray 12 may be placed at a position where the sheet discharge tray 12 is on its way of lowering, stopping to lower, raising after lowering process is finished, or the like, the predetermined distance L1 is determined in consideration of selecting any one of the aforementioned timing options.

In this embodiment, since the sheet discharge tray 12 is lowered on the basis of the standard sheet receiving position, the sheet discharge tray 12 is again raised until the sheet discharge tray 12 reaches the predetermined sheet receiving position after receiving at least the next coming sheet (or, a sheet coming after the next sheet) and after lowering the sheet discharge tray 12 in the predetermined distance L1. The reason for lowering the sheet discharge tray 12 after once raising the sheet discharge tray 12 is to accurately determine the predetermined lowering amount of the sheet discharge tray 12 at the next sheet receiving operation. This is because the position (or the height) of the top surface of the stacked sheets on the sheet discharge tray 12 is changed by receiving the sheet at a lowered position of the sheet discharge tray 12.

Further, the reason that the sheet discharge tray 12 raises at least after receiving the next sheet is that there may be a case for raising the sheet discharge tray 12 just after receiving a large number of the sheets contained in a set of the stapled sheets as a next sheet. Otherwise, there may be another case for raising the sheet discharge tray 12 after receiving a certain number of the sheets in a plurality of sheet receiving operations in case of non-stapled sheets. Accordingly, both of the cases are to clarify that there is a possibility of occurring a case that at least when the next sheet is received, the sheet discharge tray 12 is raised.

Furthermore, there may be various conditions of the sheet that trigger the movement of discharge tray 12, such as, only a set of stapled sheets, only a set of non-stapled sheets, a combination of the sets of stapled and non-stabled sheets, and the like, which are stacked on the sheet discharge tray 12. A step of an effect by a curl is considered to relate to the number of the sheets regardless of the stapled sheets or the non-stapled sheets. Accordingly, the curl of the non-staple sheets can be considered to relate to the number of copied sheets (i.e., total number of sheets). The effect by the thickness of the staples is a special problem of the stapled sheets, and this problem relates to the number of the stapled sheets and the number of the copied sheets (or perhaps even a ratio of the two, knowing an absolute number of either).

Accordingly, when setting the aforementioned predetermined stacking amount of the sheets, these components, namely, the number of the sheets, the number of the copied sheets, the number of the stapled sheets should be considered, and thereafter, a threshold value for judging whether to lower the sheet discharge tray 12 is determined. Features of this embodiment may be used exclusively or in combination with features of other embodiments of the invention, as will be discussed below.

The present embodiment describes the predetermined stacking amount as a judging basis for selecting a position of the sheet discharge tray 12 so as to receive the sheet at a position lowered from the standard sheet receiving position in consideration of the number of the discharged sheets.

Figure 11:
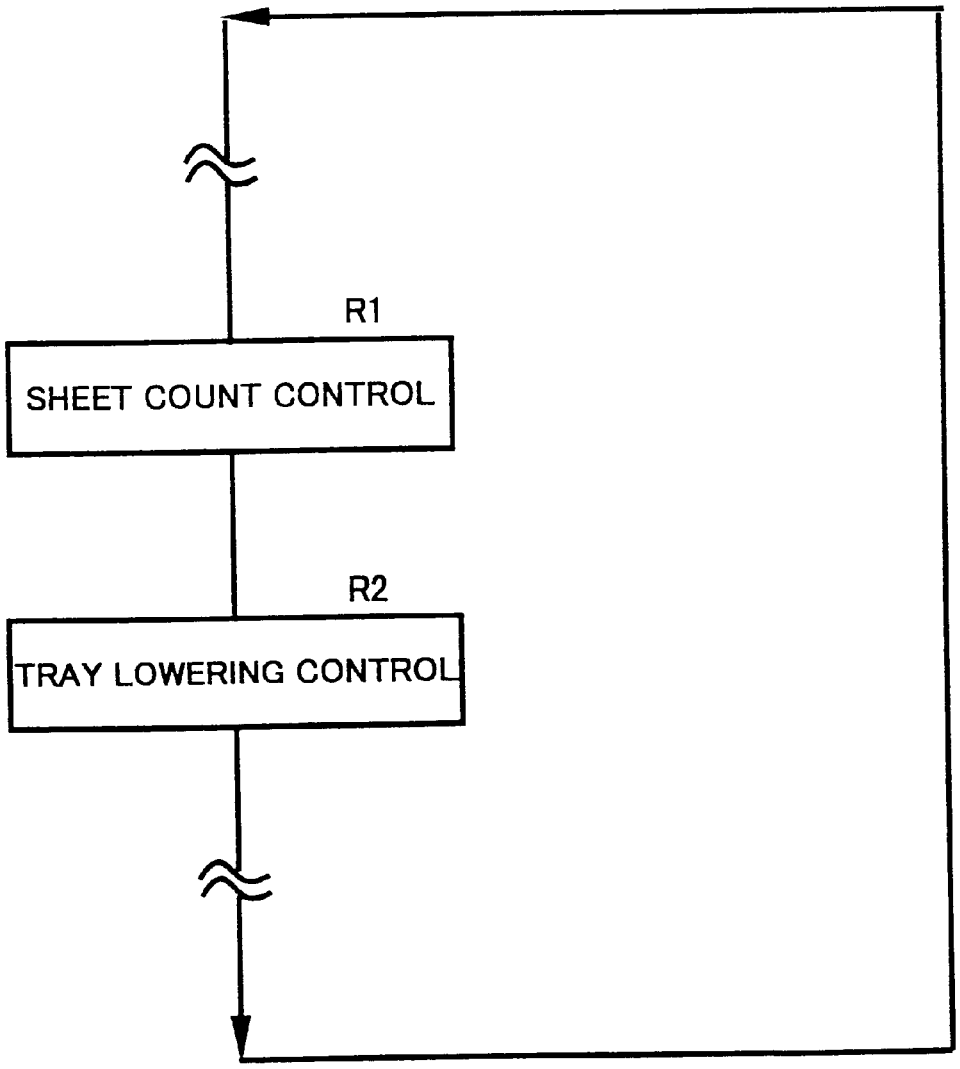
FIG. 11 is a process flow diagram illustration explaining a part of a control procedure executed by a control device.
Figure 12:
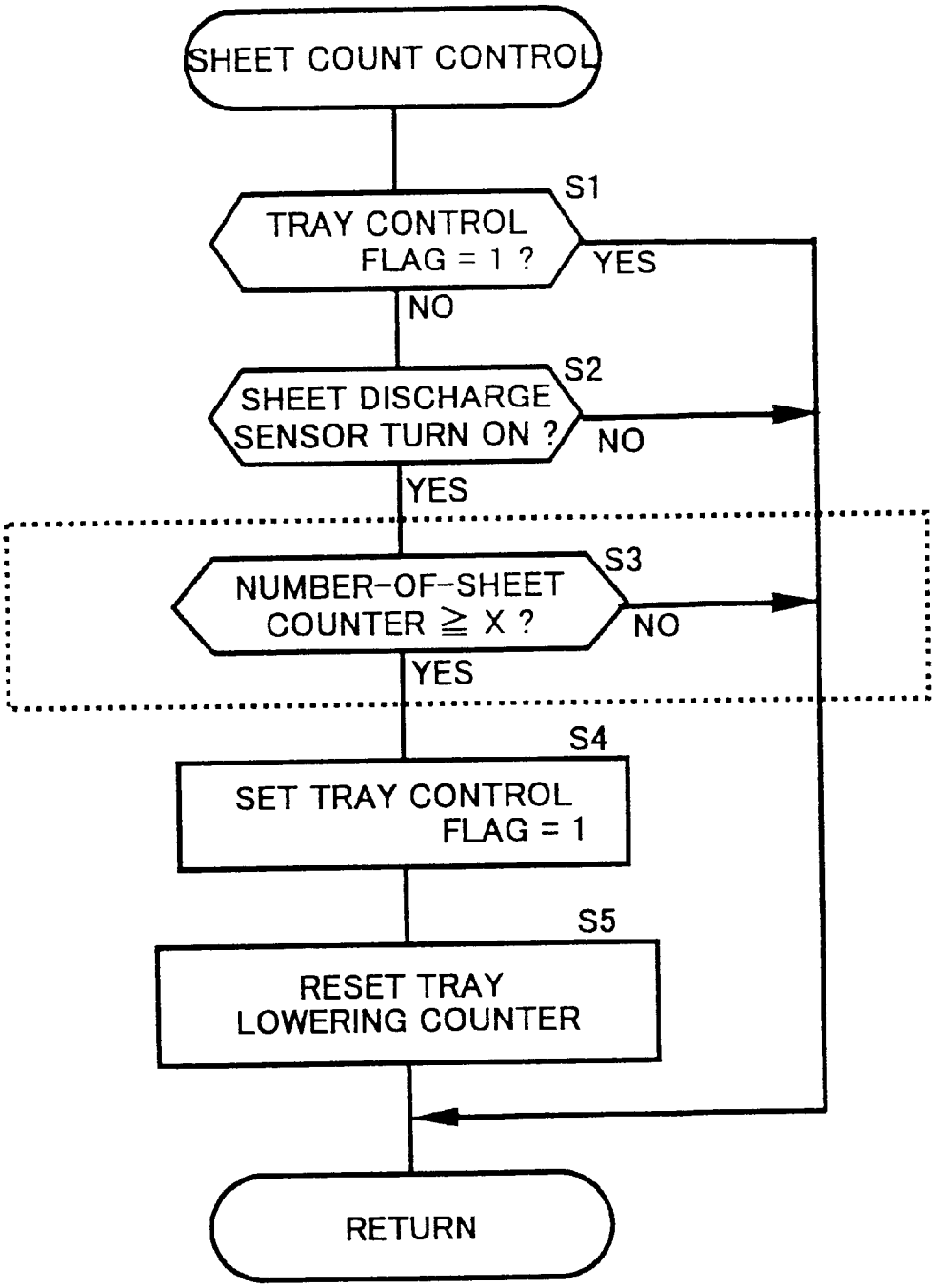
FIG. 12 is a flowchart of a part of a main program explaining a control procedure for counting a number of sheets and controlling a lowering operation of the sheet discharge tray, executed by the control device.
Figure 17:
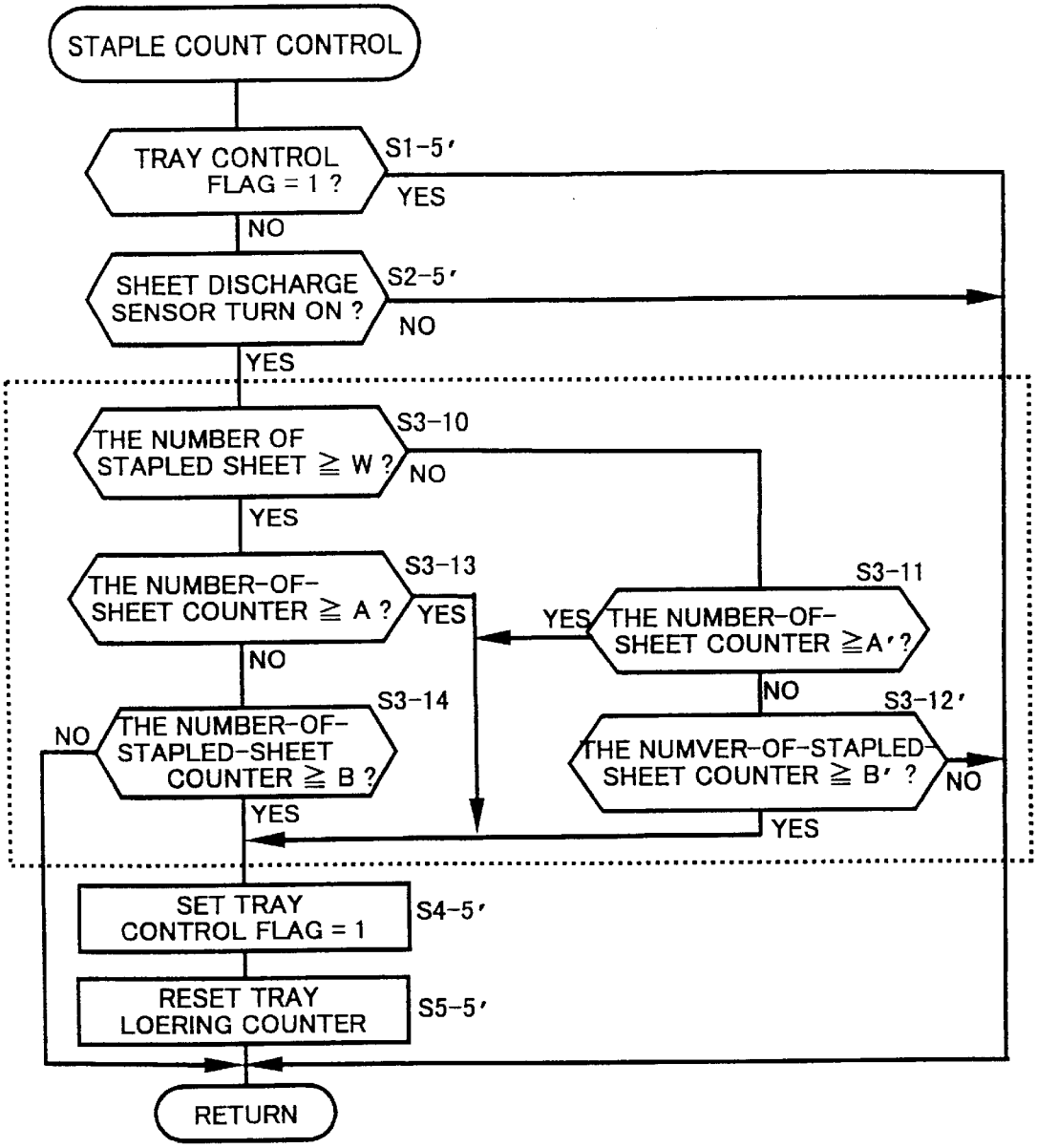
FIG. 17 is a flowchart explaining still another control procedure for the staple count control executed by the control device.

A control procedure of lowering the sheet discharge tray 12 in this case is explained by mainly referring to FIGS. 11, 12, and 17. FIG. 11 illustrates a part of a main program for sheet post processing relevant to the present embodiment where a sub-routine R1 for a control of counting the number of the sheets and a sub-routine R2 for a control of a lowering operation of the sheet discharge tray 12 are executed in order. When the sub-routine R2 is executed, the program returns to an upstream of the sub-routine R1 and then the sub-routine R1 is again executed. This cycle of the sub-routines is repeated. These controls are executed by a control device shown in the aforementioned FIG. 6. A content of the sub-routine R1 in FIG. 11 is shown in FIG. 12, and a content of the sub-routine R2 is shown in FIG. 17. This embodiment can be performed both of the usual mode and the staple mode.

The content of the sub-routine R1 in FIG. 11 is executed as a routine shown in FIG. 12, for a control of counting the number of the sheets, and the content of the sub-routine R2 is executed as a routine shown in FIG. 17, for a control of lowering operation of the sheet discharge tray 12.

A flowchart shown in FIG. 12 is hereinbelow explained. First, a controller judges whether a tray control flag is set as 1 in step S1. If the tray control flag is 1, the program takes route YES, and then RETURNs from the sub-routine to execute sub-routine R2. Further, at the beginning of the control mode for lowering the sheet discharge tray 12 relevant to the present invention, all of the flags are cleared. If a control mode for lowering the sheet discharge tray 12 is not cleared, the usual mode and the staple mode are continuously executed in the control mode for lowering the sheet discharge tray 12. In a case of continuously executing the usual mode and the staple mode, a mixture of a set of the stapled sheets and non-stapled sheets exists on the sheet discharge tray 12. In embodiments described below, a routine that is processed according to the case in FIG. 12 is described. In such a routine, the predetermined number of sheets that is compared with a value of a number-of-sheet counter contained in a control device shown in FIG. 6 (X in FIG. 16, A and A' in FIG. 17), a predetermined number of the copied sheets that is compared with a value of a number-of-stapled-set counter (K in FIG. 16), a predetermined number of a set of the stapled sheets (B and B' in FIG. 17), and the like are set in consideration of such a mixture state.

In the present invention, a tray control flag of the first state of the control mode for lowering the sheet discharge tray 12 is set to "0". Accordingly, when the answer is no in Step S1, the controller judges whether the sheet discharge sensor 38 has been turned on. This means that the sheet has passed through the sheet discharge sensor 38. Not always only one sheet passes when the sheet discharge sensor 38 is turned on, namely, according to one sheet pass operation, one sheet may pass in the usual mode, or a bundle of sheets (a set of the stapled sheets) may pass in the staple mode. In other words, a plurality of the number of the sheets contained in one set of the stapled sheets may pass at one sheet pass operation detected by the sheet discharge sensor 38.

If the controller does not judge a sheet pass operation by turning on of the sheet discharge sensor 38 in Step S2 (NO in Step S2), the sub-routine is completed by execution of the RETURN operation. If the controller judges the sheet pass operation by turning on of the sheet discharge sensor 38 (yes in Step S2), the number-of-sheet counter counts up the number of the passed sheets. Since one sheet pass operation means that one sheet has passed in the usual mode, the number-of-sheet counter counts one (adds one), and one sheet pass operation also means that the number of sheets contained in a set of the stapled sheets has passed in the staple mode, the number-of-sheet counter counts the number of sheets contained in a set of the stapled sheets for every one sheet pass operation in the staple mode.

If the controller judges the sheet sensor 38 to be turned off in Step S2, the program takes route YES and proceeds to Step S3. The controller compares the accumulated value of the number-of-sheet counter (the number of the sheets stacked on the sheet discharge tray 12) with a predetermined number of the sheets X. A user removes the sheets from the sheet discharge tray 12 and thereby the sheet discharge tray 12 raises to a standard sheet receiving position counting a time required to raise the sheet discharge tray 12 by a time counter.

The constant time is determined so that the stacked amount of the sheets is brought to a state that any problem does not occur due to the curl or the thickness of the staples.

The predetermined number of the sheets X is set to a value in which the aforementioned misalignment of the sheets caused by the curl or an interference between the stacked sheets and the sheet discharge roller 3 may occur at the first time. If the accumulated value of the number-of-sheet counter once exceeds the predetermined number of the sheets X, the sheet cannot be accepted on the sheet discharge tray 12 at the standard sheet receiving position thereof any longer. In this embodiment, the sheet is hereinafter received at a position to which the sheet discharge tray 12 is lowered from the standard sheet receiving position.

Thereby, the controller monitors whether the accumulated value of the number-of-sheet counter has reached the predetermined number of the sheets X in Step S3. If the value of the number-of-sheet counter is less than the predetermined number of the sheets X, the sheet discharge tray 12 receives the sheet at the standard sheet receiving position (as described later in Step S7 in FIG. 18).

If the value of the number-of-sheet counter is judged to have reached the predetermined number of the sheets X, in Step S3, the controller sets the tray raise control flag to 1 in Step S4, and resets a tray lowering counter that counts a lowering time of the sheet discharge tray 12, in FIG. 5.

Figure 18:
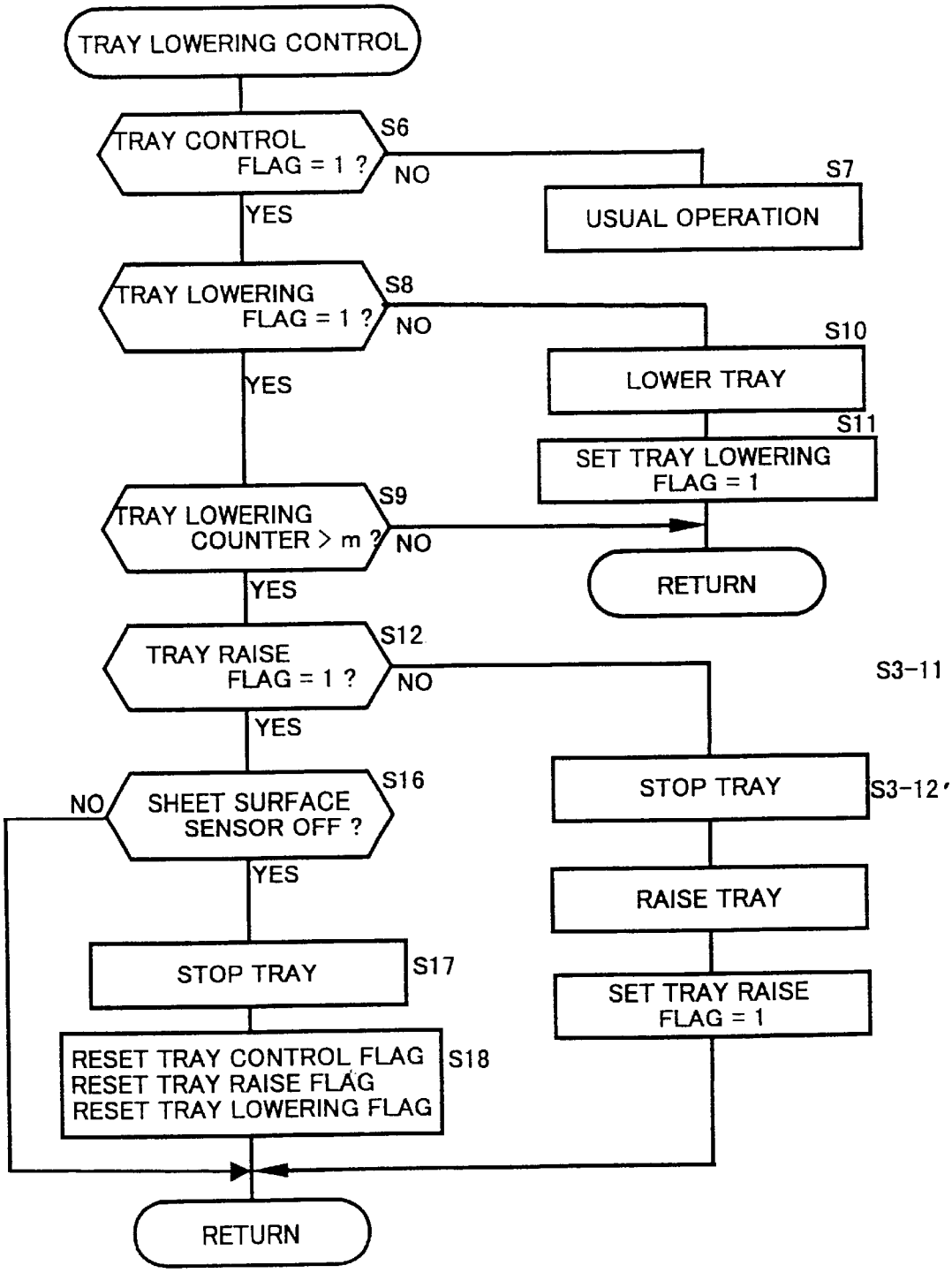
FIG. 18 is a flowchart explaining a control procedure for a raising-and-lowering operation of the sheet discharge tray executed by the control device.

A flowchart shown in FIG. 18 is explained hereinbelow. Until the number-of-sheet counter reaches the predetermined number of the sheets X in Step S3, a tray control flag stays to be cleared at a time when checked in Step S6 in FIG. 18. The program takes route NO, and the sheet discharge tray 12 repeats to receive the sheet at the standard sheet receiving position in Step S7. The procedure is called a usual operation and the position of the sheet discharge tray 12 is placed at the predetermined standard sheet receiving position. The position is controlled within a constant range by the sheet surface sensor 32 and 33.

By such a routine repeated in the usual operation in Step S7, the accumulated value of the number-of-sheet counter increases. If the value of the number-of-sheet counter exceeds the predetermined number of the sheets X in Step S3 in FIG. 12, the tray control flag is set to "1" in Step S4 and the program proceeds to Step S6 in FIG. 18. Thereby, the controller takes route YES and then proceeds to Step S8.

The controller judges whether the tray lowering flag is "1" in Step S8. Since the tray lowering flag is cleared at the beginning, the program takes route NO, and proceeds to a sub-routine of lowering the tray in Step S10. In the sub-routine of tray lowering, up-and-down motor 23 is driven and the sheet discharge tray 12 is started to lower. A lowering counter starts counting the lowering counter simultaneously with a start of lowering the sheet discharge tray 12. Further, the tray lowering flag is set to "1" in Step S10 and the program passes away to RETURN.

When the sheet discharge tray 12 is lowered, since the tray lowering flag is set "1" in Step S10, the program takes YES in Step S8 from the next time, and the program compares and checks a time count value of a tray lowering counter with a predetermined threshold value "m" in Step S11. The tray lowering counter is a timer in a control device shown in FIG. 6, and counts one time unit every 5 ms. The sheet discharge tray 12 is continuously lowered until the count value reaches the predetermined threshold value m.

When the sheet discharge tray 12 is lowered, the sheet detected by the aforementioned sheet discharge sensor 38 is received by the sheet discharge tray 12. A concrete threshold value m is set in consideration of a conveying speed of the conveyed sheet, a lowering speed of the sheet discharge tray 12, a distance between the sheet discharge sensor 38 and the sheet discharge tray 12 (the receiving position of the sheet by the sheet discharge tray 12 in consideration of the step of mounding of the stacked sheets), and the like. Thus, depending on setting the threshold value m, the sheet discharge tray 12 can receive the sheet at any one of the positions where the sheet discharge tray 12 is on its way of lowering, stopping after lowering, or raising after stopping.

If the count value reaches the threshold value m or more of the tray lowering counter in Step S11, the program takes route YES in Step S11 and checks whether the tray raising flag is set to "1" in Step S12. Since the tray raising flag is cleared at the beginning, the program proceeds to Step S13, and thereafter, the sheet discharge tray 12 stops lowering according to an execution of a sub-routine of tray stop. Next, the sheet discharge tray 12 starts raising by an execution of a sub-routine of tray raising in Step S14. Then, the program sets a tray raising flag to "1" in Step S15, and executes a RETURN operation.

The sheet surface sensor 32 or 33 is turned on by lowering of the sheet discharge tray 12. However, the sheet discharge tray 12 stops by the turning off of the sheet surface sensor 32 or 33 according to raising of the sheet discharge tray 12. In other words, the sheet surface sensor is judged to be whether turned off in Step S16, and if turned off in Step S16, the program proceeds to Step S17 and stops to raise the sheet discharge tray 12. The reason that the sheet discharge tray 12 is thus raised to the standard sheet receiving position in Step S17 is not for receiving the sheet at the position, but for setting a standard position for lowering the sheet discharge tray 12 at a time when the next sheet is received. This is because the position (height) of the top surface of the stacked sheets is already changed.

This embodiment relates to a control procedure for setting the predetermined stacking amount as a judging basis for switching a sheet receiving position in consideration of a number of the sheets contained in a set of the stapled sheets. The judging basis of switching the sheet receiving position of the sheet discharge tray 12 is not intended to set to the standard sheet receiving position but to the position in which the sheet discharge tray 12 is lowered from the standard sheet receiving position when the staple mode is selected.

A lowering control of the sheet discharge tray 12 in the present invention is executed by a flowchart shown in FIG. 11. A content of the sub-routine R1 of the sheet count control in FIG. 11 is executed by a procedure of the flowchart for the staple count control shown in FIG. 13. Further, the content of the sub-routine R2 of the tray lowering control in FIG. 11 is executed by a procedure of the flowchart for tray lowering control shown in FIG. 18. Namely, the control of the present embodiment is executed by a combination of the flowcharts shown in FIGS. 13 and 18. The content of the control shown in FIG. 18 is already explained, and therefore, a flowchart in FIG. 13 is mainly explained hereinbelow.

Figure 13:
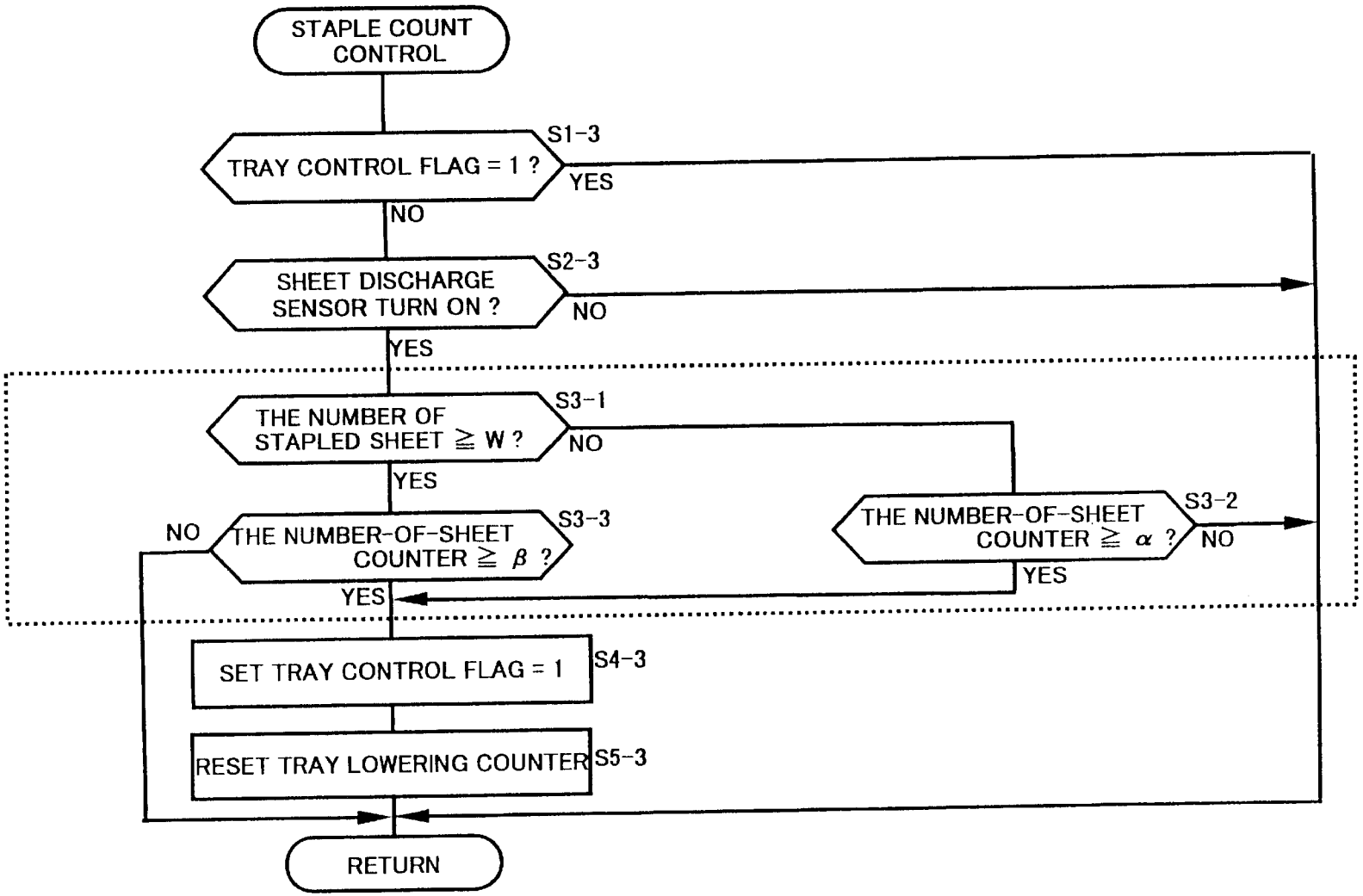
FIG. 13 is a flowchart explaining the control procedure for a staple count control executed by the control device.

In FIG. 13, a basic construction of the process is common with that shown in FIG. 12. The process (surrounded by a broken line in FIG. 12) for judging whether the sheet discharge tray 12 has reached a state to be lowered which corresponds to Step S3 in FIG. 12 is replaced with a process of a combination of the Steps S3-1, Step S3-2, and Step S3-3 in FIG. 13 which is also surrounded by a broken line. This is a difference between the processes, and the processes shown in FIGS. 12 and 13 are all the same except for this difference. In other words, Steps S1, S2, S4, and S5 in FIG. 12 correspond to Steps S1-3, S2-3, S4-3, and S5-3 in FIG. 13, respectively.

Accordingly, avoiding a redundancy of explanation, a process surrounded by a broken line in FIG. 13 is mainly explained.

In this embodiment, a pass of the sheet is detected by a switching of the sheet discharge sensor 38 from OFF to ON, namely, the program proceeds to Step S3-1 when the answer is judged to be YES in Step S2-3. At this moment, one sheet pass detected by the sheet discharge sensor 38 represents a pass of a bundle of sheets. In other words, a set of the stapled sheets has passed at one detection by the sheet discharge sensor 38. If a sheet pass is recognized by a change of the sheet discharge sensor 38 from OFF to ON, the control device shown in FIG. 6 counts up the number of passed sheets in the number-of-sheet counter included therein.

In the staple mode, since one sheet pass represents that the number of sheets contained in a set of the stapled sheets has passed, the number of the sheets contained in a set of the stapled sheets is accumulated for every sheet pass.

When the user removes the sheet from the sheet discharge tray 12 the sheet discharge tray 12 raises to the standard sheet receiving position. Then, the controller clears the number-of-sheet counter when the sheet discharge tray 12 raises for a certain time.

At this moment, the aforementioned certain time is determined according to the time required for the sheet discharge tray 12 to raise when the sheet on the sheet discharge tray 12 is removed so that a remaining amount of the stacked sheets does not cause a problem by the curl or by the thickness of the staples.

The number of sheets contained in a set of the stapled sheets that is set at the staple mode and the predetermined number of the sheets contained in a set of the stapled sheets W are compared in Step S3-1. This predetermined number of the sheets W is set as the number of the sheets contained in a set of the stapled sheets as a threshold value whether the aforementioned misalignment of the sheets caused by thickness of a staples occurs. If the number of the sheets contained in a set of the stapled sheets in the staple mode exceeds the predetermined number of the sheets W, the thickness of the staples can be disregarded.

Otherwise, if the number of the sheets contained in a set of the stapled sheets is less than the predetermined number of the sheets W, the thickness of the staples cannot be disregarded. If the number of the sheets contained in a set of the stapled sheets is judged to be less than the predetermined number of the sheets W in Step S3-1, the program takes route NO, and proceeds to Step S3-2. If the number of the sheets contained in a set of the stapled sheets is judged to be equal to or more than the predetermined number of the stapled sheets W in Step S3-1, the program takes the route YES and proceeds to Step 3-3.

A value of the number-of-sheet counter and the predetermined number of the sheets $\alpha$ are compared in Step S3-2. The predetermined number of the sheets $\alpha$ is a value determined in consideration of the number of the sheets contained in a set of stapled sheets, and when a value of the number-of-sheet counter is divided by the number of the sheets contained in a set of the stapled sheets determined by the staple mode, the number of the staples can be calculated. Since the number of the staples that elicits an effect by the staples is already known by empirical evidence, previously collected, the number of the sheets when the effect of the staples appears at the first time is set as the number of the sheets $\alpha$.

Therefore, the program passes away to RETURN for executing the usual operation in FIG. 18 until value of the number-of-sheet counter reaches the predetermined value $\alpha$ in Step S3-2, and when the value of the number-of-sheet counter has reached the predetermined number of the sheets $\alpha$, the program proceeds to Step S4-3 so as to execute a lowering control for the sheet discharge tray 12.

The value of the number-of-sheet and the predetermined number of the sheets $\beta$ are compared in Step S3-3. The predetermined number of the sheets $\beta$ is mainly determined in consideration of the effect of the curl. Further, since the number of sheets when the effect of the curl elicits at a time when the number of the sheets contained in a set of the stapled sheets is more than the predetermined number of the sheets W, is already known by empirical evidence, the number of the sheets when the curl effect appears at first is set as the predetermined number of the sheets $\beta$.

Accordingly, the program a RETURN operation so as to execute the usual operation in FIG. 18 when the value of the number-of-sheet counter is less than the predetermined number of the sheet $\beta$ in Step S3-3, and if the value of the number-of-sheet counter reaches the predetermined number of the sheets $\beta$, the program proceeds to Step S4-3 so as to execute a lowering control of the sheet discharge tray 12. The control is hereinbelow pursuant to the process relevant to a combination of FIGS. 12 and 18.

The embodiment described below relates to a control procedure for determining a predetermined stacking amount as a judging basis to switch the receiving position of the sheet discharge tray 12 so as to receive the sheet not at a standard receiving position but at a position to which the sheet discharge tray is lowered from the standard sheet receiving position, in consideration of the number of the sets of the stapled sheets when the staple mode is selected.

The lowering control of the sheet discharge tray 12 in the present embodiment is executed by a procedure of a flowchart shown in FIG. 11. A content of the sub-routine R1 of the sheet count control in FIG. 11 is executed by a procedure of a flowchart for a staple count control shown in FIG. 14. Further, a content of the sub-routine R2 of the tray lowering control in FIG. 11 is executed by a procedure of a flowchart for the tray lowering control shown in FIG. 18. In other words, the control of the present embodiment is executed by a procedure of a combination of the flowcharts shown in both of FIGS. 14 and 18.

Figure 14:
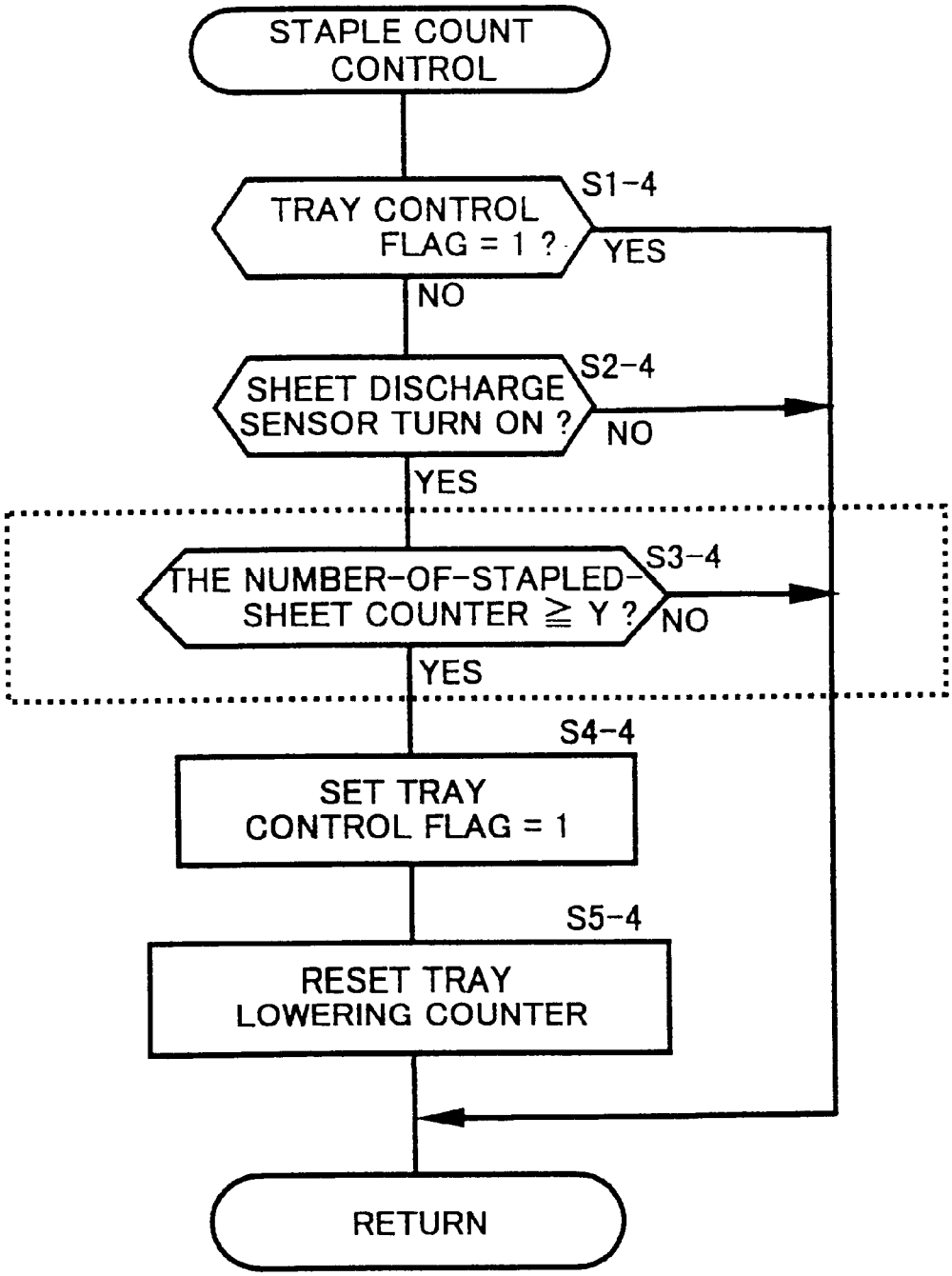
FIG. 14 is a flowchart explaining another control procedure for the staple count control executed by the control device.

Since the content of the control shown in FIG. 18 is already explained, a flowchart shown in FIG. 14 is mainly explained hereinbelow. A basic construction of the process in FIG. 14 is common with that in FIG. 12. The difference between the two processes is that a process relevant to Step S3 in FIG. 12 (shown in a portion surrounded by a broken line) for determining whether the sheet discharge tray 12 is brought to a state of lowering the same is replaced by a process (shown in a portion surrounded by a broken line) relevant to Step S3-4 in FIG. 14. The processes shown in FIGS. 12 and 14 other than above are completely the same. Namely, the Steps S1, S2, S4, and S5 in FIG. 12 corresponds to the Steps S1-4, S2-4, S4-4, and S5-4, respectively. Therefore, to avoid redundancy of an explanation, a process of the portion surrounded by the broken line in FIG. 14 is mainly explained.

In this embodiment, a sheet pass is detected by switching of the sheet discharge sensor 38 from OFF to ON in FIG. 14, namely, when the program judges YES in Step S2-4, the program proceeds to Step S3-4. At this moment, a set of the stapled sheets has passed per one sheet pass detected by the sheet discharge sensor 38. If a sheet pass is recognized by a change of the sheet discharge sensor 38 from OFF to ON, the number-of-sheet counter contained in the control device shown in FIG. 6 counts up the number of the sets of the stapled sheets.

Since the number of the sheets contained in a set of the stapled sheets is already known in the staple mode, the number of the staples can be calculated from the number of the sets of the stapled sheets.

The accumulated value of the number-of-sheet counter is cleared when the sheet discharge tray 12 raises for a certain time after the user has removed the sheet from the sheet discharge tray 12 and then the counter counts the time required for raising the sheet discharge tray 12 that raises to the standard sheet receiving position. At this instant, the aforementioned certain time is determined according to a time required for raising the sheet discharge tray 12 after the sheet on the sheet discharge tray 12 is removed so that a remaining amount of the stacked sheets avoids the problem caused by the thickness of the staples.

An accumulated value of a number-of-stapled-set counter and the predetermined number of the number of the sets of the stapled sheets Y are compared in the staple mode in Step S3-4. The predetermined number of the sheets Y is set as a number of the sets of the stapled sheets for a threshold value whether the misalignment of the sheets as mentioned above caused by the thickness of the staples occurs.

If the value of the number-of-stapled-set counter is less than the predetermined number of the sheets Y, the effect of the staples can be disregarded, and if the value of the number-of-stapled-set counter is equal to or more than the predetermined number of the stapled sheets Y, the effect of the staples cannot be disregarded.

Accordingly, the program compares the number of the number-of-stapled-set counter and the predetermined number of the sheets Y in Step S3-4. The program control then returns by a RETURN operation so as to execute the usual operation in FIG. 18 until a value of the number-of-stapled-set counter reaches the predetermined number of the sheets Y. The program then proceeds to Step S4-4 so as to execute the lowering control of the sheet discharge tray 12 when the value of the number-of-stapled-set counter reaches the predetermined number of the sheets Y in Step S3-4. The control is hereinafter pursuant to the aforementioned process of the combination of FIGS. 12 and 18.

The embodiment described below relates to a control procedure for determining a stacking amount as a judging basis of switching a sheet receiving position so as to receive the sheet not at a standard position but at a position lowered from the standard sheet receiving position when the staple mode is selected, in consideration of the number of the sheets and the number of the sets of the stapled sheets to which the staple process is executed.

The control procedure of this embodiment is also provided in consideration of a case in which stapled sheets and non-stapled sheets are stacked on the sheet discharge tray 12 in a mixed state resulting from continuously performing both of the staple mode and the usual mode. A lowering control of the sheet discharge tray 12 in the present embodiment is executed by a procedure of the flowchart shown in FIG. 11. The content of the sub-routine R1 for a sheet count control in FIG. 11 is executed by a procedure of a flowchart for a staple count control shown in FIG. 16. Further, the content of the sub-routine R2 in FIG. 11 is executed by a procedure of a flowchart for a tray lowering control shown in FIG. 18. Namely, the control of the present embodiment is executed by a combination of the flowcharts shown in FIGS. 16 and 18.

Figure 16:
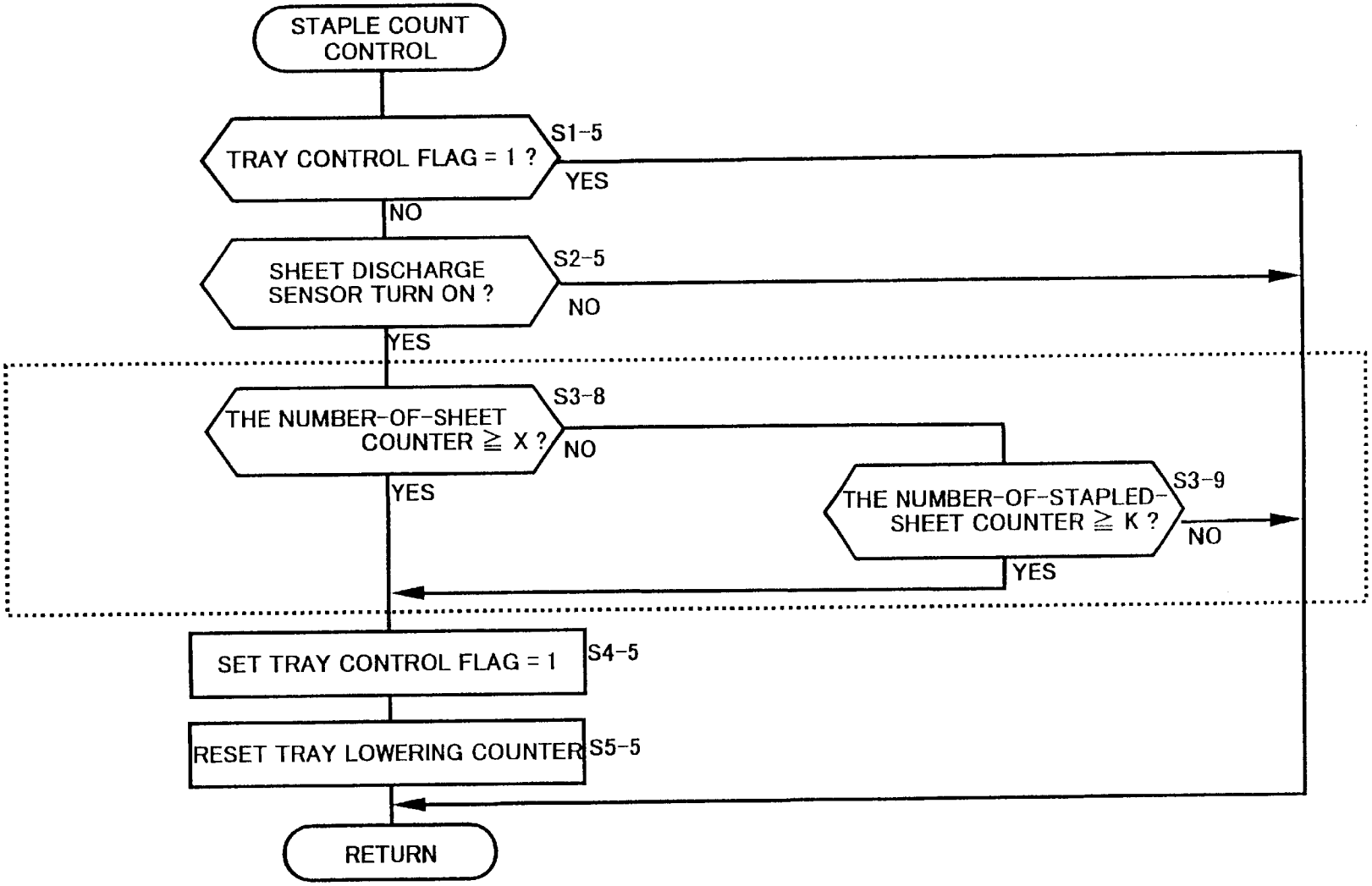
FIG. 16 is a flowchart explaining still another control procedure for the staple count control executed by the control device

The content of the control shown in FIG. 18 is already explained and therefore, the flowchart in FIG. 16 is mainly explained hereinbelow.

A basic construction of the process in FIG. 16 is common with that in FIG. 12. The difference between the constructions as stated above is that a process corresponds to Step S3 (surrounded by a broken line) in FIG. 12 relevant to the process for determining whether the sheet discharge tray 12 is brought to a state to be lowered is replaced by a process composed of a combination of each of the Steps S3-8 and S3-9 (surrounded by a broken line).

The process in FIGS. 12 and 16 other than above-mentioned process is completely the same. Namely, the Steps S1, S2, S4, and S5 in FIG. 12 correspond to the Steps S1-5, S2-5, S4-5 and S5-5, respectively.

Therefore, to avoid the redundancy of the explanation, the process that is surrounded by a broken line in FIG. 16 is mainly explained.

In the present embodiment, a sheet pass is detected by switching the sheet discharge sensor 38 from OFF to ON in FIG. 16. Namely, if the program judges YES in Step S2-5, then program proceeds to Step S3-8. At this instant, when a sheet pass is detected by the sheet discharge sensor 38, this means that one sheet has passed. When a sheet pass is recognized by a change of the sheet discharge sensor 38 from OFF to ON, the control device shown in FIG. 6 counts up the number of a passed sheet in the number-of-sheet counter contained therein.

The number of sheets contained in the set of the stapled sheets is already known when the staple mode is selected, and the number of the sets of the stapled sheets is also known by the accumulated value of the number-of-stapled-set counter. Accordingly, the number of the sheets is calculated from these values and the number-of-sheet counter contained in the control device shown in FIG. 6 counts up the value as the number of the sheets.

The accumulated values of the number-of-sheet counter and the number-of-stapled-sheet counter are cleared when the sheet discharge tray 12 raises for a certain time after the user has removed the sheet from the sheet discharge tray 12 and then the time counter counts the time required for raising the sheet discharge tray 12 that raises to the standard sheet receiving position. At this instant, the aforementioned certain time is determined according to a time required for raising the sheet discharge tray 12 after the sheet on the sheet discharge tray 12 is removed so that a remaining amount of the stacked sheets is made not to give rise to the problem caused by the thickness of the staples.

An accumulated value of the number-of-sheet counter is compared with the predetermined number of the sheets X in Step S3-8. The predetermined number of the sheet X is set as a value that may cause the misalignment of the sheets such as that as mentioned above caused by the curl of the sheet and an interference of the sheet and the sheet discharge roller 3, at the first time. If the accumulated value of the number-of-sheet counter once exceeds the predetermined number of the sheets X, the sheet cannot be received on the sheet discharge tray 12 at the standard sheet receiving position any longer.

In the present embodiment, the sheet is thereafter received at a position where the sheet discharge tray 12 is lowered from the standard sheet receiving position. Thereby, the program compares the value of the number-of-sheet counter with the predetermined number of the sheets X in Step S3-8. If the value of the number-of-sheet counter has reached the predetermined number of the sheets X, the program proceeds to Step S4-5 to execute the lowering control for the sheet discharge tray 12.

Further, even though the effect of the curl is not judged to exist because of the value of the number-of-sheet counter to be judged less than the predetermined number of the sheets X, the effect of the thickness of the staples may possibly occur depending on the number of the stapled sheets. Therefore, the program proceeds to Step S3-9 and compares the value of the number-of-stapled-sheet counter with the predetermined number of the sets of the stapled sheets K. If the value of the number-of-stapled-sheet counter has reached the predetermined number of the sets of the stapled sheets K, the program proceeds to Step S4-5 so as to execute the lowering control of the sheet discharge tray 12. If the value of the number-of-stapled-sheet counter is less than the predetermined number of the sets of the stapled sheets K, the program passes away to RETURN to execute the usual operation in FIG. 18 until the value of the number-of-stapled-sheet counter reaches the predetermined number of the stapled sheets K.

This predetermined number of the sets of the stapled sheets K is set as a threshold value whether the aforementioned misalignment of the sheets caused by thickness of staples occurs or not. The control described below follows a process relevant to a combination of FIGS. 12 and 18.

This embodiment relates to a control procedure for determining the predetermined stacking amount as a judging basis of switching a sheet receiving position in consideration of the number of the sets of the stapled sheets and the number of the sheets contained in a set of the stapled sheets, and the number of the sheets, the number of the sets of the stapled sheets and the number of the sheets contained in a set of the stapled sheets. The judging basis of switching the sheet receiving position of the sheet discharge tray 12 is not intended to set to the standard sheet receiving position but to the position in which the sheet discharge tray 12 is lowered from the standard sheet receiving position when the staple mode is set.

The control procedure of this embodiment is also provided in consideration of a case in which stapled sheets and non-stapled sheets are stacked on the sheet discharge tray 12 in a mixed state resulting from continuously performing the staple mode and the usual mode.

The lowering control of the sheet discharge tray 12 in the present embodiment is executed by a procedure of the flowchart shown in FIG. 11. The content of the sub-routine R2 is executed by replacing the flowchart for a staple count control shown in FIG. 15. Further, the content of the sub-routine R2 for the tray lowering control in FIG. 11 is executed by using a procedure of the flowchart for the tray lowering control shown in FIG. 18. Namely, the present embodiment is executed by a combination of procedures of the flowchart shown in FIGS. 15 and 18. Since the content of the control shown in FIG. 18 is already explained, the flowchart in FIG. 15 is mainly explained hereinbelow.

Figure 15:
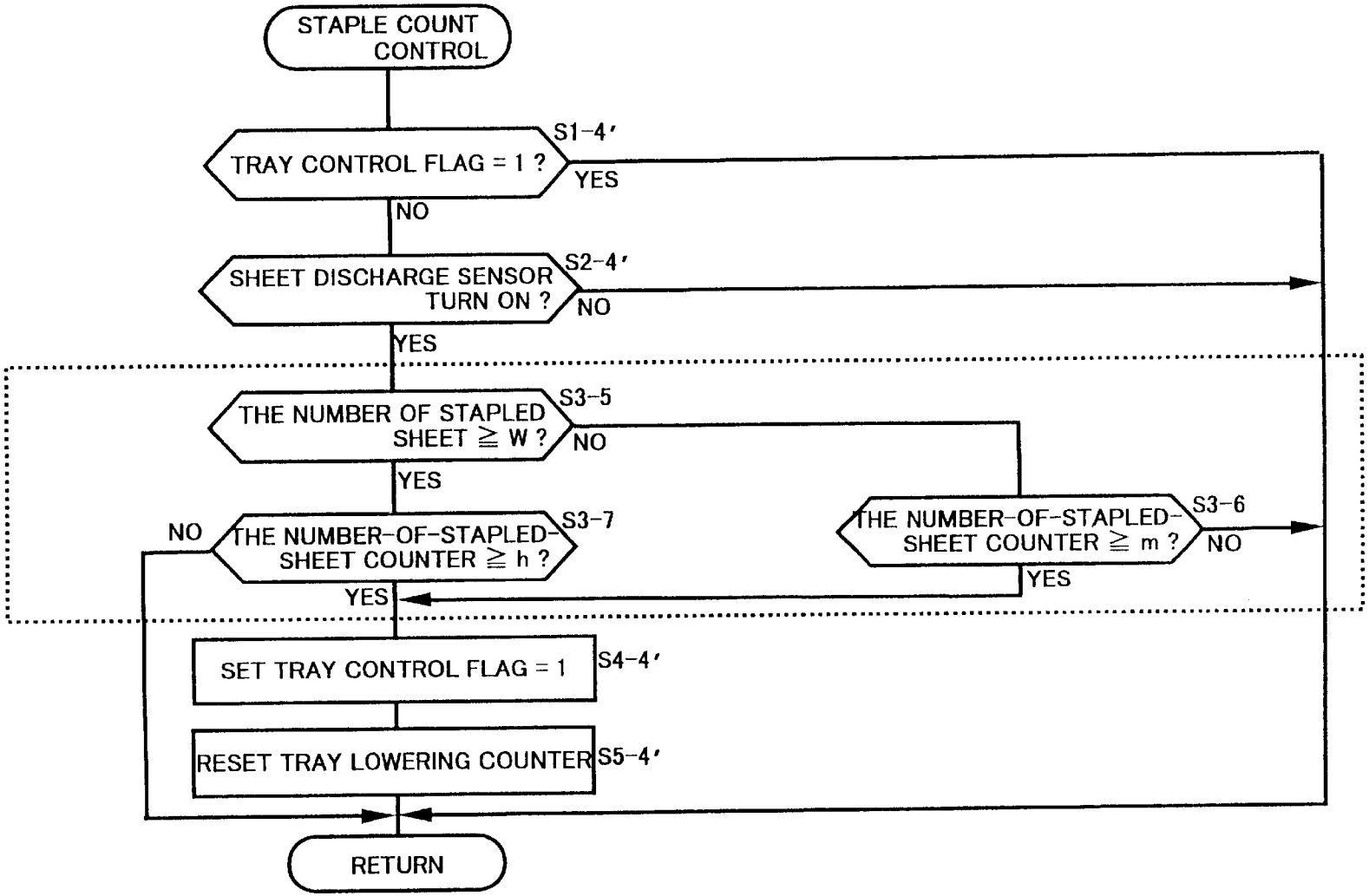
FIG. 15 is a flowchart explaining still another control procedure for the staple count control executed by the control device.

The basic construction of the process in FIG. 15 is common with those in FIGS. 12 and 14. A process corresponding to Step S3 in FIG. 12 for determining whether the sheet discharge tray 12 is brought to a state of lowering (surrounded by a broken line) is replaced by a process in FIG. 15 (surrounded by a broken line) composed of a combination of the Steps S3-5, S3-6, and S3-7, as a difference from the FIG. 15.

The process in FIG. 12 other than the above stated process is completely the same with that in FIG. 15. Namely, Steps S1, S2, S4, and S5 in FIG. 12 correspond to Steps S1-4', S2-4', S4-4', and S5-4' in FIG. 15 respectively.

Accordingly, to avoid redundancy of the explanation, the process that is surrounded by the broken line in FIG. 15 is mainly explained.

In this embodiment, a sheet pass is detected by switching the sheet discharge sensor 38 from OFF to ON in FIG. 15. Namely, if the program judges an answer YES in Step S2-4', then the program proceeds to Step S3-5. At this instant, a pass of a bundle of sheets, i.e., a set of the stapled sheets is detected by one sheet pass detection at the sheet discharge sensor 38.

If a sheet pass is recognized by a change of the sheet discharge sensor 38 from OFF to ON, the control device shown in FIG. 6 counts up the number of the set of the stapled sheets to the number-of-sheet counter contained therein. The accumulated value of the number-of-sheet counter is cleared when the sheet discharge tray 12 raises for a certain time after the user has removed the sheet from the sheet discharge tray 12 and then the counter counts the time required for raising the sheet discharge tray 12 that raises to the standard sheet receiving position. At this instant, the aforementioned certain time is determined according to a time required for raising the sheet discharge tray 12 after the sheet on the sheet discharge tray 12 is removed so that a remaining amount of the stacked sheets is made not to not give rise to the problem caused by the thickness of the staples.

The number of the sheets contained in a set of the stapled sheets which is set in the staple mode, and the predetermined number of the sheets W contained in a set of the stapled sheets are compared in Step S3-5. This predetermined number of the sheets W is set for the number of the sheets contained in the set of the stapled sheets as a threshold value for whether the aforementioned misalignment of the sheets caused by thickness of staples occurs.

In Step S3-5, if the number of a set of the stapled sheets is judged to be less than the predetermined number of the set of the stapled sheets W, the program takes route NO, and proceeds to Step S6. If the number of a set of the stapled sheets is judged to be equal to or more than the number of a set of the stapled sheets, the program takes route YES, and proceeds to Step S3-7.

In Step S3-7, the program compares the value of the number of the sets of stapled sheets and the predetermined number of the sets of stapled sheets h. If the value of the number-of-stapled-sheet counter has reached the predetermined number of the sets of the stapled sheets h, the program proceeds to Step S4-4', and if the value of the number-of-stapled-sheet has not reached the predetermined number of the sets of the stapled sheets h, the program returns control by executing a RETURN operation so as to execute the usual operation in FIG. 18 until the value reaches the predetermined number of the sets of the stapled sheets h.

Since the predetermined number of the sets of stapled sheets h is a threshold value set in a manner similar to the predetermined number of the sheets W in Step S3-5 in FIG. 15, the explanation of the threshold value h is omitted to avoid a redundancy of the explanation.

A lowering control of the sheet discharge tray 12 is executed by the procedure of the flowchart shown in FIG. 11. The sub-routine R1 in FIG. 11 is replaced by a flowchart for a staple count control shown in FIG. 17. In addition, the content of the sub-routine R2 for a control of a lowering operation of the sheet discharge tray 12 is executed by use of the flowchart for control of a lowering operation of the same in FIG. 18. In other words, the control of the present embodiment is executed by a combination of the flowcharts shown in FIGS. 17 and 18.

Since the content of the control shown in FIG. 18 is already explained, a flowchart in FIG. 17 is mainly explained hereinbelow.

In FIG. 17, a basic construction of the process is common with that in FIGS. 12 and 16. The process that corresponds to Step 3 in FIG. 12 relevant to the process for determining whether the sheet discharge tray 12 is brought to a state of lowering (the portion surrounded by a broken line) is replaced by Steps S3-10, 3-11, 3-12, 3-13, and 3-14 (the portion surrounded by a broken line) in FIG. 17. That is the difference between the processes shown in FIGS. 12 and 17.

The process shown in FIG. 12 other than that stated above is completely the same as the process shown in FIG. 17. Namely, Steps S1, S2, S4, and S5 in FIG. 12 correspond to Steps S1-5', S2-5', S4-5', and S5-5', respectively. In Step S3-10, the number of the sheets contained in a set of the stapled sheets which is set in the staple mode and the predetermined number of the sheets W contained in the stapled sheets are compared. This predetermined number of the sheets W is set for the number of the sheets as a threshold value whether the misalignment of the sheets as described earlier caused by the thickness of the staples occurs.

In Step S3-10, if the number of the sheets contained in the set of stapled sheets set in the staple mode is equal to or more than the predetermined number of the sheets W, the effect of the staples can approximately be disregarded. Otherwise, if the number of the sheets contained in the set of stapled sheets is less than the predetermined number of the sheets W, the effect of the staples cannot be disregarded.

In Step S3-10, if the number of the sheets contained in the set of stapled sheets is less than the predetermined number of the sheets W, the program takes route NO and proceeds to Step S3-11. In Step S3-11, an accumulated value of the number-of-sheet counter is compared with the predetermined number of the sheet A' of the sheets contained in a set of the stapled sheets. The predetermined number of the sheets A' is set as a value in which the aforementioned misalignment of the sheets caused by the curl of the sheet or the interference of the sheet and the sheet discharge roller 3 may occur at the first time.

If the accumulated value of the number-of-sheet counter once exceeds the predetermined number of the sheet A', the sheet cannot be received on the sheet discharge tray 12 at the standard sheet receiving position any longer. In this embodiment, the sheet discharge tray 12 receives the sheet at a position in which the sheet discharge tray 12 is lowered from the standard sheet receiving position. Thereby, the value of the number-of-sheet counter is compared with the predetermined number of the sheet A' in Step S3-11. If the value of the number-of-sheet counter has reached the predetermined number of the sheet A', the program proceeds to Step S4-5' to execute lowering operation of the sheet discharge tray 12.

Further, even though the effect of the curl of the sheet can be disregarded when the value of the number-of-sheet counter is less than the predetermined number of the sheet A' in Step S3-11, the effect of the thickness of the staples may appear when the number of the sets of the stapled sheets increases. Therefore, if the value of the number-of-sheet counter is less than the predetermined number of the sheet A' in Step S3-11, the program takes route NO and checks the effect of the staples in Step S3-12.

In Step S3-12, a value of the number-of-stapled-sheet counter is compared with the predetermined number of the sets of the stapled sheets B'. If the value of the number of the sets of the stapled sheets has reached the predetermined number of the sets of the stapled sheets B', the program proceeds to Step S4-5' to execute lowering operation of the sheet discharge tray 12. If the value of the number of the sets of the stapled sheets is less than the predetermined number of the sets of the stapled sheets B', the program control returns by executing a RETURN operation.

In Step S3-10, if the number of the sheets contained in a set of the stapled sheets is judged to be equal to or more than the predetermined number of the sheets W, the program executes the similar process as that in Steps S3-11 and S3-12 so as to check the effect of the thickness of the staples and the effect of the curl. If the program judges the effect of the thickness of the staples and the curl not to be disregarded, then the program proceeds to Step S4-5', and if the effect is judged to be disregarded, then program control returns by executing a RETURN operation.

In other words, even though the effect of the curl can be disregarded when the value of the number-of-sheet counter is less than the predetermined number of the sheet A, and if the number of the sets of the stapled sheets increases, the effect of the thickness of the staples appears. Accordingly, if the value of the number-of-sheet counter is less than the number of the sheets A in Step S3-13, the program takes route NO and checks the effect of the thickness of the staples in Step S3-14.

In Step S3-14, the controller compares the value of the number-of-stapled-sheet counter with the predetermined number of the set of the stapled sheet B. If the value of the number-of-stapled-sheet counter has reached the predetermined number of the set of the stapled sheet B, the program proceeds to Step S4-5' since the effect of the staple may appear, and if the value of the number-of-stapled-sheet counter is less than the predetermined number B, then the program control returns by executing a RETURN operation.

The predetermined number of the set of the stapled sheet B is set as a threshold value whether the aforementioned misalignment of the sheets occur caused by the thickness of the staples for staple process.

These predetermined numbers of the sheets X, A, A', W, $\alpha$, $\beta$ in the predetermined embodiments, the predetermined number of the sheets in a set of the stapled sheets W, and the predetermined numbers of the sets of the stapled sheets K, B, B', Y, h, m, as threshold values can be set at more detailed step.

On the other hand, as described earlier, a problem occurs if the sheet discharge roller 3 rotates while the sheet discharge roller 3 touches the sheet stacked on the sheet discharge tray 12. In the present invention, the sheet discharge tray 12 is therefore lowered from the standard sheet receiving position by the controller in an amount of the distance in which the top surface of the stacked sheets separates from at least the sheet discharge roller 3 before the sheet discharge roller 3 starts rotation when the sheet is to be discharged.

By thus controlling the operation, the problem can be resolved. After that, the controller supports the sheet discharge tray 12 at a first sheet receiving position which is lower than the standard sheet receiving position, namely, the position indicated by two-dots-and-a-dash line in FIG. 10, and distant from the sheet discharge roller 3 in the distance L1. The controller can execute a first down mode in which the sheet discharge tray 12 is controlled to receive the sheet at the first sheet receiving position.

When the controller has completely finished to discharge the sheet at the first sheet receiving position, the controller raises the sheet discharge tray 12 to the standard sheet receiving position after stopping the rotation of the sheet discharge roller 3 to avoid an interference with the sheet, and wait for the next coming sheet. The same control is repeated.

Even though the sheet discharge roller 3 is prevented from rotation at a contact with the sheet, a drop of the sheet is brought to be large because the first sheet receiving position (the position of the distance L1 in FIG. 10) is lower than the standard sheet receiving position (the position of the distance L in FIG. 10) looking from the sheet discharge roller 3. Accordingly, a downstream tip end portion of the sheet with less rigidity tends to curl (a tip end curl) and may cause a problem of damage of the sheet.

To resolve such a problem, the controller executes a second down mode (or simply, "second mode") in addition to the first down mode. In the second mode, the sheet discharge tray 12, which is once lowered, is raised toward the standard sheet receiving position after the sheet discharge roller 3 starts rotation, and before the sheet is discharged from the sheet discharge roller 3.

Thus, by raising the sheet discharge tray 12 before the sheet is discharged from the sheet discharge roller 3, and by receiving the tip end portion of the sheet with the surface of the sheet discharge tray 12 before the tip end curl of the sheet occur, the tip end curl can be avoided.

Accordingly, the raising operation of the sheet discharge tray 12 can be continued until the sheet is completely discharged not only at the tip end portion but also at the trailing edge thereof. Depending on a control timing or a setting level of the moving speed of the sheet discharge tray 12, the sheet discharge tray 12 may reach the standard sheet receiving position before the trailing edge of the sheet is completely discharged.

Assuming that such a situation occurs, the trailing edge of the sheet on its way to be discharged cannot be completely discharged, since a curly surface portion of the top surface of the sheet on the sheet discharge tray 12 or a portion having a staple may touch the sheet discharge roller 3.

To avoid such a problem, in addition to the control mentioned above, the controller controls the sheet discharge tray 12 to again lower after the sheet discharge tray 12 has raised and before the discharge of the sheet from the sheet discharge roller 3 is finished, i.e., before the trailing edge of the sheet is discharged onto the sheet discharge tray 12. In this case, the sheet discharge tray 12 is stopped at the time when reaching the first sheet receiving position.

Accordingly, the sheet while being discharged may be completely discharged at the trailing edge onto the sheet discharge tray 12 on its way of lowering. Otherwise, the sheet may be discharged on the sheet discharge tray 12 that is waiting at the first sheet receiving position. In either case, the sheet is discharged onto the sheet discharge tray 12 without any problem.

As described above, when the sheet is completely discharged, the sheet discharge tray 12 is raised until the sheet discharge tray 12 reaches the standard sheet receiving position after stopping the rotation of the sheet discharge roller 3 to avoid interference with the sheet, and wait for the next coming sheet. The same control procedure is repeated.

These controls can be executed with the control device that follows a procedure hereinbelow explained by use of FIG. 19. In this case, to construct a sheet stacking apparatus that can make the aforementioned first down mode and the second down mode selectable, the program follows the flowchart in FIG. 19.

Figure 19:
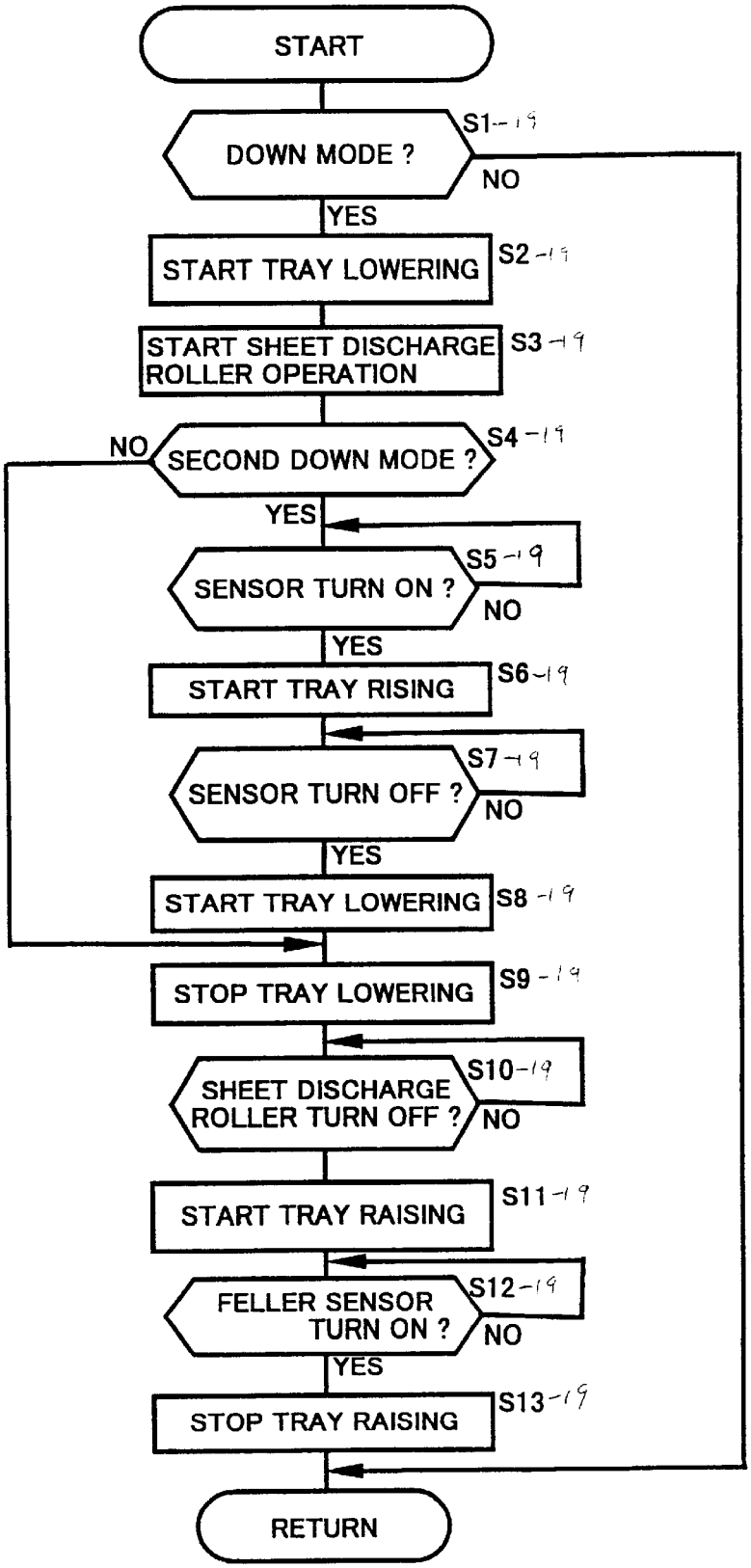
FIG. 19 is a flowchart explaining a control procedure for a rotation of a sheet discharge roller and the raising-and-lowering operation of the sheet discharge tray executed by the control device.

To construct a sheet stacking apparatus capable of executing the first down mode, the program follows the flowchart in which the procedures of Steps S4 to S8 are omitted in the flowchart in FIG. 19.

To construct a sheet stacking apparatus capable of executing the second down mode, the program follows the flowchart in which the procedure of Step S4 is omitted.

In these cases, a selection of each of the modes, such as the first mode, second mode, and the like may be executed by switching a selection key for the modes mounted in a control panel, or in a case of a combination of an apparatus capable of selecting the staple mode, the program may be set by linking with the staple mode. Otherwise, the program may be set by linking with a detected information from a device that can recognize a sheet easy to curl regardless of the usual mode or the staple mode.

When any one of the down modes is selected, the control device recognizes the mode and judges YES in Step S1-19 or Step S4-19 in FIG. 19.

At this moment, even though the standard sheet receiving position is different in case of the usual mode and the staple mode to avoid a complication, a position of the sheet discharge tray 12 where there is a distance L between the sheet discharge tray 12 (the top surface of the tray when the sheet is not exist on the sheet discharge tray 12, and the top surface of the sheet when the sheet exist on the sheet discharge tray 12) and the sheet discharge roller 3 is defined as the standard sheet receiving position in either case.

An embodiment of the down mode in a sheet post processing apparatus including a sheet stacking apparatus having the construction shown in FIGS. 1 to 8 is mainly explained with the staple mode by use of FIG. 19.

In FIG. 19, the program judges whether the flowchart is for the down mode, according to any one of changes for discharging the sheet capable of being discharged to the sheet stacking apparatus, namely, a start detection of the discharge belt 10 by the discharge belt home sensor 37 according to a start of the discharge motor 57 as a trigger, or a sheet detection by the entrance sensor 36 at the usual mode. If the down mode is selected, the program proceeds to Step S2-19, and if the down mode is not selected, then the program returns by executing a RETURN operation.

Figure 20:
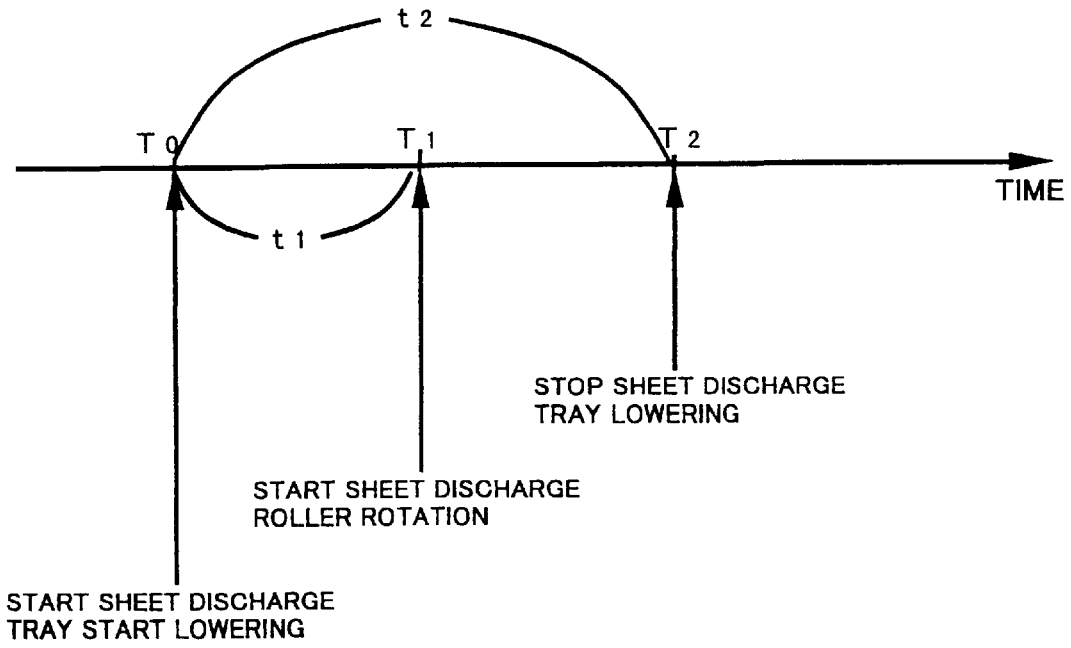
FIG. 20 is a timing chart explaining a lowering operation of the sheet discharge tray.

A timer starts count a time on the basis of the time point $T_0$ (time point 0) in FIG. 20, as a trigger, and the sheet discharge tray 12 simultaneously starts lowering from the standard sheet receiving position (as indicated by a solid line in FIG. 10).

The sheet discharge roller 3 starts rotation at a time point $T_1$ at which a predetermined time $t_1$ has passed from the time point $T_0$. The time $t_1$ is predetermined as a time in which the sheet discharge roller 3 needs to separate from the sheet on the sheet discharge tray 12 (Step S3-19). The predetermined time $t_1$ can be set as a time between a time point when the discharge pawl 10*a* starts moving at the home position and the time point when the discharge pawl 10*a* starts raising with the stapled sheets after hooking the stapled sheets at the position of the rear end fence 19.

The program judges whether the second down mode in Step S4-19 at the same time of executing the process in Step S3-19. If the second down mode is not selected, the program jumps to Step S9-19 and executes the first down mode, and if the second down mode is selected, then the program proceeds to Step S5-19. The two of the cases, the first down mode and the second down mode are separately explained hereinafter.

a. First down mode

The sheet discharge tray 12 that starts lowering in the aforementioned Step S2-19 stops lowering at a time point $T_2$ after a predetermined time $t_2$ has passed from the time point $T_1$. The time $t_2$ is determined as a time in which the sheet discharge tray 12 needs to lower from the time point $T_0$ to the first sheet receiving position (indicated by a two-dots-and-a-dash line in FIG. 10). The sheet discharge tray 12 stays at the first sheet receiving position (Step S9-19).

The sheet has been proceeded until this moment. The sheet discharge roller 3 is stopped rotation at a time point when a predetermined time has passed from the time when the sheet discharge sensor 38 detects a trailing edge of the sheet by a timer, in which the predetermined time is determined as a required time from the time when the trailing edge of the sheet is detected by the sheet discharge sensor 38 to the time when the sheet is completely discharged onto the sheet discharge tray 12 (Step S10-19).

If the rotation of the sheet discharge roller 3 has stopped, the top surface of the sheet can touch the sheet discharge roller 3 with no problem, and accordingly, the sheet discharge tray 12 can be raised instantly. The sheet discharge tray 12 is raised in Step S11-19. Therefore, the sheet discharge tray 12 is stopped in Step S13-19 under a condition of turning ON of the sheet surface sensor 32 via the sheet surface lever 13 in Step S12-19. Thereby, the sheet discharge tray 12 returns the standard sheet receiving position indicated by a solid line in FIG. 10, and waits the next coming sheet. The same control is repeated hereinafter.

b. Second down mode

In the state in which the sheet discharge roller 3 is rotating, and the sheet discharge tray 12 is lowering, the program waits the tip end detection of the sheet by the sheet sensor 38 in Step S5-19. If the tip end of the sheet is detected by the sheet discharge sensor 38, the sheet discharge tray 12 that is lowering is changed to raise (Step S6-19). This is to receive the tip end of the sheet at the sheet discharge tray 12 in a state of being located at a high position for preventing the tip end of the sheet from curling.

The best position of the sheet discharge tray 12 according to the above object can be determined to the standard sheet receiving position. Accordingly, it is effective that a predetermined time difference for raising the sheet discharge tray 12 to a position where the sheet can be received without causing the tip end curl is set between Steps S5-19 and S6-19. This time difference is experimentally determined and is set by a timer.

The tip end of the sheet is judged to be thus completely discharged onto the sheet discharge tray 12 by detecting the trailing edge of the sheet with the sheet discharge sensor 38. However, for this purpose, the position of the sheet discharge sensor 38 is required to satisfy a predetermined condition in relation to the sheet discharge roller 3, the sheet discharge tray 12, and the size of the sheet. In this embodiment, since the sheet discharge sensor 38 is located adjacent to the sheet discharge roller 3, when the trailing edge of the sheet is detected by the sheet discharge sensor 38, the tip end of the sheet is fully discharged on the sheet discharge tray 12.

In Step S7-19, when the trailing edge of the sheet is detected by the sheet discharge sensor 38, the sheet discharge tray 12 that has already started raising in Step S6 is changed to lower before the trailing edge of the sheet passes away through the sheet discharge roller 3 according to a timer that controls the time on the basis of the time point of detecting the trailing edge of the sheet. This lowering operation of the sheet discharge tray 12 is performed to obtain space for the sheet that is discharged on the sheet discharge tray 12 to slide down along the slope and is rammed against the rear end fence 29 at the trailing edge thereof without interfering with the sheet discharge roller 3.

The trailing edge of the sheet is discharged by the sheet discharge roller 3 at least after a time point at which such a space is obtained. This lowering operation is stopped in Step S9-19. Since the procedure after Step S9-19 is described in the aforementioned section "a. First down mode", the explanation is presently omitted.

The present invention can be applied not only to the sheet discharge tray for the aforementioned sheet post processing apparatus but also to the sheet discharge tray for an image forming apparatus.

The controller of this invention may be conveniently implemented using a conventional general purpose digital computer of microprocessor programmed according to the teachings of the present specification, as is apparent to those skilled in the computer technology. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

Obviously, numerous modifications and variations of the present invention are possible in light of the above teachings. It is therefore to be understood that within the scope of the appended claims, the invention may be practiced otherwise than as specifically described herein.

Having now fully described the present invention, it will be apparent to one of ordinary skill in the art that many changes and modifications can be made thereto without departing from the spirit and scope of the invention as set forth herein.

This document is based on Japanese patent Applications No. JPAP 09-330101 filed in Japan on Dec. 1, 1997 and No. JPAP 10-042261 filed in Japan on Feb. 24, 1998, the entire contents of all of which being hereby incorporated by reference.

What is claimed is:

1. A sheet stacking apparatus comprising:

a sheet discharge tray configured to move up and down and hold a sheet that is discharged thereto; and a sheet discharge roller located above said sheet discharge tray and rotatable to discharge the sheet to said sheet discharge tray, wherein said sheet discharge tray receives the sheet from said sheet discharge roller at a standard sheet receiving position which is located at a predetermined downward distance away from said sheet discharge roller, and said sheet discharge tray moves down to a lower position than said standard sheet receiving position by a predetermined distance and receives at least a next sheet at said lower position, when a stacked amount of sheets on said sheet discharge tray reaches a predetermined stacking amount;

a plurality of sensors configured to identify a top of the stacked amount of sheets; and a lever configured to cooperate with said plurality of sensors to control a movement of said sheet discharge tray by moving said lever to a sensing position of at least one of said plurality of sensors corresponding to an operating mode of said apparatus.

2. The sheet stacking apparatus according to claim 1, wherein:

said predetermined stacking amount is set in consideration of a number of sheets.

3. The sheet stacking apparatus according to claim 1, wherein:

said sheet discharge tray is configured to receive a set of stapled sheets from said sheet discharge roller, and said predetermined stacking amount is set in consideration of a number of sheets contained in the set of the stapled sheets.

4. The sheet stacking apparatus according to claim 2, wherein:

said sheet discharge tray receives the sheets which include a set of staple processed sheets from said sheet discharge roller, and said predetermined stacking amount is set in consideration of a number of sheets contained in the set of staple processed sheets.

5. The sheet stacking apparatus according to claim 1, wherein:

said sheet discharge tray receives the sheets which include a set of staple processed sheets from said sheet discharge roller, and said predetermined stacking amount is set in consideration of a number of sets of staple processed sheets.

6. The sheet stacking apparatus according to claim 1, wherein:

said sheet discharge tray receives the sheets which include a set of staple processed sheets from said sheet discharge roller, and said predetermined stacking amount is set in consideration of a total number of sheets and a number of sets of stapled sheets.

7. The sheet stacking apparatus according to claim 5, wherein:

said sheet discharge tray receives said predetermined stacking amount, which is set in consideration of a number of sheets contained in the set of staple processed sheets in addition to a number of sets of staple processed sheets.

8. The sheet stacking apparatus according to claim 6, wherein:

said predetermined stacking amount is set in consideration of a number of sheets contained in the set of staple processed sheets in addition to a total number of sheets and a number of sets of stapled sheets.

9. A sheet stacking apparatus comprising:

means for holding a sheet;

means for discharging the sheet to said means for holding the sheet at a position lower than a discharge output of said means for discharging;

means for moving said means for holding from a standard sheet receiving position which is a predetermined distance lower than said discharge output, including means for moving said means for holding to an even lower position that said standard sheet receiving position upon detecting a predetermined event;

means for sensing a top of said sheet; and means for controlling, in cooperation with said means for sensing, said means for moving by moving said means for controlling to a sensing position of said means for sensing corresponding to an operating mode of said apparatus.

* * * * *